US008111589B2

(12) United States Patent
Vidal

(10) Patent No.: US 8,111,589 B2
(45) Date of Patent: Feb. 7, 2012

(54) DIGITAL WRISTWATCH, DIGITAL WATCH, AND DIGITAL CLOCK

(76) Inventor: Joel Vidal, New York, NY (US)

( * ) Notice: Subject to any disclaimer, the term of this patent is extended or adjusted under 35 U.S.C. 154(b) by 181 days.

(21) Appl. No.: 12/761,165

(22) Filed: Apr. 15, 2010

(65) Prior Publication Data

US 2011/0255379 A1 Oct. 20, 2011

(51) Int. Cl.
*G04B 25/00* (2006.01)

(52) U.S. Cl. ..... 368/71; 368/84; 368/242

(58) Field of Classification Search ..... 368/71, 368/84, 242, 223, 82
See application file for complete search history.

(56) References Cited

U.S. PATENT DOCUMENTS

| | | | | |
|---|---|---|---|---|
| 6,307,813 | B1 * | 10/2001 | Leggio | 368/63 |
| 6,751,165 | B2 * | 6/2004 | Blonder | 368/82 |
| 7,079,454 | B2 * | 7/2006 | Wellen | 368/230 |
| 7,136,326 | B1 * | 11/2006 | Smith | 368/223 |
| 2007/0258336 | A1 * | 11/2007 | Bailey | 368/223 |
| 2010/0061190 | A1 * | 3/2010 | Nelson | 368/10 |

* cited by examiner

*Primary Examiner* — Sean Kayes

(57) ABSTRACT

Digital wristwatch, digital watch, and digital clock. For example, a digital wristwatch comprises: a clocking module able to track: (a) current real time, and (b) rounded time; and a display unit able to display at least the rounded time. Additionally or alternatively, the digital wristwatch comprises: a clocking module able to determine current real time; a rounding unit able to determine that the real current time is at least two seconds prior to a rounded horological hour, and able to calculate rounded-up horological information; and a display unit able to display the rounded-up horological hour.

14 Claims, 27 Drawing Sheets

DIGITAL WRISTWATCH, DIGITAL WATCH, AND DIGITAL CLOCK

FIELD

Some embodiments are related to the field of digital clocks and digital watches.

BACKGROUND

Many people wear a wristwatch which indicates the exact current time. Knowledge of the exact current time assists a person in performing various scheduled tasks, for example, arriving to a meeting at a pre-scheduled time without delays, calling a business associate by phone at a particular pre-scheduled time, turning on the television at a particular time in order to watch a live sporting event as it starts, or the like.

Some wristwatches are analog and use a dual-hand mechanism to indicate the current horological information of hours and minutes; or use a triple-hand mechanism to indicate the current horological information of hours, minutes and seconds.

Other wristwatches are digital, and present the current time using a digital display. For example, a digital watch may display the string "4:56:37" to indicate that the current time is 37 seconds past 56 minutes past four o'clock, optionally accompanied by the indication "AM" or "PM".

Some digital wristwatches may utilize a 12-hour time format, and may present the current time in the format of "4:56:37 PM". Other digital wristwatches may utilize a 24-hour time format, and may present the current time in the format of "16:56:37".

Some digital wristwatches may include additional functionalities, which may be activated or operated using one or more buttons. Such functionalities may include, for example, an alarm mechanism allowing the user to set the wristwatch to beep or sound an alarm at a particular time; a stopwatch able to count the elapsing time from zero and onward; a miniature calculator function; or the like.

SUMMARY

Some embodiments may include, for example, a digital wristwatch, a digital watch, or a digital clock.

In some embodiments, the digital watch may be child-friendly, or may be suitable for utilization by children or by persons with certain disabilities.

In some embodiments, the digital watch presents simplified horological information or reduced-complexity horological information.

In some embodiments, the digital watch presents only the hour component of horological information, optionally followed by ":00", optionally followed by either "AM" or "PM".

In some embodiments, the digital watch presents substantially continuously only a single number, which is an integer in the range of 1 to 12, optionally followed by either "AM" or "PM"; such that the single integer displayed is equal to the nearest whole-hour horological time.

In some embodiments, for example, if the current real time is "4:58" or "5:03", then the digital watch may intentionally display rounded-time of "5" or "5:00" or "5 PM" or "5:00 PM" or "5 o'clock" or "five o'clock", instead of displaying the real time, which is also tracked by the digital watch but is not displayed.

In some embodiments, if the current real time is "3:58" or "4:03", then the digital watch may intentionally display rounded-time (e.g., "4" or "4 PM") together with the real time, which may be displayed using a smaller size or smaller font-size.

Some embodiments may thus provide a digital wristwatch, a digital watch, or a digital clock which shows only a truncated or cropped horological information; or, which shows only a rounded hours component; or, which shows only simplified and reduced-detail horological information which may be suitable or easier for reading and/or comprehending by children or by persons with certain disabilities.

Some embodiments may provide other and/or additional benefits and/or advantages.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION OF SOME EMBODIMENTS

Figure 1:
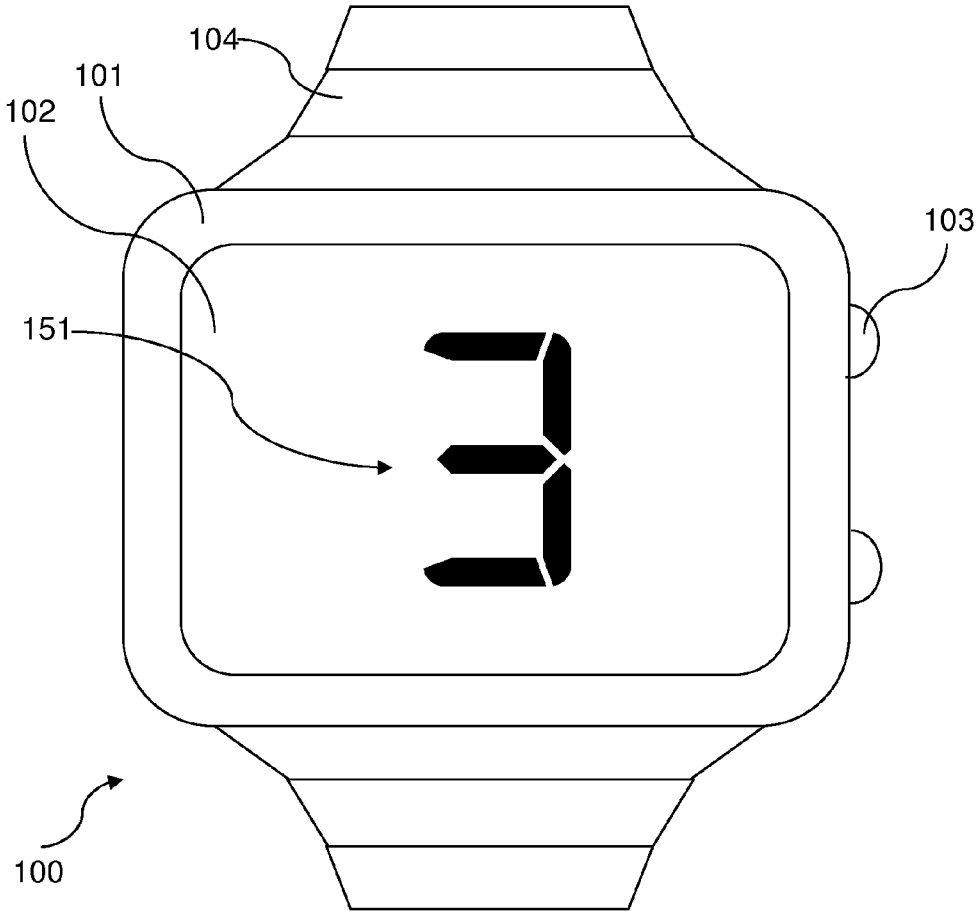
FIGS. 1-16 are schematic illustrations of a digital watch in accordance with some demonstrative embodiments.

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Some embodiments include, for example, a digital watch, a digital wristwatch, a digital clock, and other clock or watch devices.

Some embodiments include, for example, a digital clock or digital watch which displays only hour information and not minute information and not second information; and the hour information which is displayed is not the actual or real-time hour information, but rather, rounded hour information.

In some embodiments, for example, the digital watch or digital clock is able to determine that the current time is "4:57" (namely, 57 minutes after 4 o'clock); but instead of displaying the time as "4:57", the digital watch or digital clock rounds-up the time to the nearest hour and displays only "5" or the string "5 o'clock" or a simplified string corresponding to the rounded-up hour information.

In some embodiments, for example, the digital watch or digital clock is able to determine that the current time is "4:55:36" (namely, 36 seconds after 55 minutes after 4 o'clock); but instead of displaying the time as "4:55", the digital watch or digital clock rounds-up the time to the nearest hour and displays only "5" or the string "5 o'clock" or a simplified string corresponding to the rounded-up hour information.

In some embodiments, for example, the digital watch or digital clock is able to determine that the current time is "8:04" (namely, 4 minutes after 8 o'clock); but instead of displaying the time as "8:04", the digital watch or digital clock rounds-down the time to the nearest hour and displays only "8" or the string "8 o'clock" or a simplified string corresponding to the rounded-up hour information time.

In some embodiments, for example, the digital watch or digital clock is able to determine that the current time is "8:04:29" (namely, 29 seconds after 4 minutes after 8 o'clock); but instead of displaying the time as "8:04:29", the digital watch or digital clock rounds-down the time to the nearest hour and displays only "8" or the string "8 o'clock" or a simplified string corresponding to the rounded-up hour information time.

In some embodiments, the digital watch or digital clock may be used, for example, by a child, a toddler, an infant, a teenager; a senior citizen; a person who is visually impaired; a person who may be incapable of reading and/or understanding and/or processing and/or utilizing a long or complex horological string such as "4:56:38" or "4:57" yet may be capable of reading and/or understanding and/or processing and/or utilizing a short or reduced-complexity horological string such as "5"; a person who is only partially familiar with reading and/or comprehending horological information; a person (e.g., an immigrant or a tourist) who is less familiar with numerals used in the United States of America or in Europe; a person who does not need, or does not desire, to utilize or to live by horological granularity or resolution of seconds or minutes, but rather, needs or desires to utilize or live by horological granularity or resolutions of hours; a person who wish to reduce or eliminate time-related pressures which may be related with the continuous ability to know or track the exact current time; a person who needs or desires to utilize, or to live by, approximated horological information or rounded horological information; a person who does not need, or does not want, to track the passage of time on a minute-by-minute basis or on second-by-second basis, but rather, chooses to enjoy life at a slower or less-stressful pace by utilizing only rounded hourly horological information; or the like.

In some embodiments, for example, a four-year-old child may not be able to read and/or comprehend a complex horological string such as "4:56:38" or "4:57" or "5:04" or "5:03:47"; and/or such four-year-old child may not have any incentive or direct benefit from understanding or utilizing such fine-resolution horological information since the child may not need to track time on a second-by-second basis or on minute-by-minute basis, since the child may not have a need to attend a meeting or an event particularly at "4:57", but rather, was told by his mother to come back home at 5 o'clock or around 5 o'clock. Such child may be confused or discouraged by the provision of complex and redundant horological information which the child does not need and which increases the complexity of reading and/or comprehending and/or utilizing the time which is displayed by conventional digital watches and clocks as a complex string with information that the child not only does not need, but also, burdens and hinders and interferes with the child's ability to read, comprehend and/or utilize the horological components (e.g., the rounded hour information) which the child may be interested in.

In some embodiments, a child may wear a digital wristwatch able to show a single value of horological information corresponding not to the current time, and not to the current hour, but rather, to a rounded value of the current hour. In some embodiments, the child-friendly digital wristwatch may present, as time information, only one of the following twelve values: "1", or "2", or "3", or "4", or "5", or "6", or "7", or "8", or "9", or "10", or "11", or "12". In some embodiments, optionally, the rounded hourly value may be followed by an indication of "AM" or "PM"; or by the string "o'clock". In some embodiments, the rounded hourly value may be presented not as a numerical value (e.g., "7") but rather as a word (e.g., "seven" or "SEVEN") or as a phrase (e.g., "Seven O'clock").

In some embodiments, the digital wristwatch may present, as time information, rounded hourly information based on a 24-hour scheme or using "military notation" of time, for example, utilizing an integer in the range of 0 to 23.

In some embodiments, the rounded hourly information may be presented exclusively, such that minute information and/or second information is not presented.

In some embodiments, the rounded hourly information may be different form truncated horological information. Some embodiments do not merely truncate or crop an horological string corresponding to the real current time in order to provide to the user less horological data; but rather, some embodiments determine the real current time, and then calculate and display a different, inaccurate, time which is based on rounding (e.g., rounded-up or rounded-down) of the hourly horological information.

For example, if the exact current time is "4:57:16", then: a conventional digital watch which displays only hour and minute information, will display the time as "4:57" by truncating the seconds information. Optionally, if a conventional digital watch was able to further truncate the minutes information, then such modified digital watch would have displayed the time as "4" when the real time is "4:57:16". In contrast, in some embodiments, the digital watch shows the time as "5" when the real time is "4:57:16", clearly demonstrating that the digital watch in some embodiments does not merely truncate or crop the time information, and does not merely discard one or more components of the horological string; but rather, calculates and displays a different horological value which does not correspond to the exact current time. Therefore, the functionality of the digital watch in some embodiments differs significantly from the functionality of a conventional digital watch which merely truncates a less-significant portion of the horological information; such conventional digital watch does not perform the rounding of the hourly information and does not continuously display the rounded time instead of the real time.

In some embodiments, the displayed time is not merely an incorrect time which does not match the real time; such incorrect time may be presented by a conventional digital watch which is simply wrongly set by its user. For example, if a user sets her conventional digital watch to run 20 minutes ahead of the real time (by mistake, or on purpose), then, when the real time is "4:35:17", such incorrectly-set conventional watch may show the time as "4:55:17" or as "4:55"; while, in contrast, the digital watch of some embodiments may show the time as "5" since the real time of "4:35:17" is rounded-up to the nearest whole hour. Therefore, the functionality of the digital watch in some embodiments differs significantly from the functionality of a conventional digital watch which is merely set to an incorrect time that does not precisely match the real time or the official time; such conventional digital watch, which shows an incorrect or inaccurate time due to an intentional or mistaken setting by its user, does not perform the rounding of the hourly information and does not continuously display the rounded time instead of the real time.

In some embodiments, the rounding of the hourly information may be performed such that any time in the range of "4:30:00" to "5:29:59" may be rounded to, and displayed as, "5" or as "Five" or as "Five O'clock" or as "5 o'clock" or as "5 AM" or as "5 PM"; that any time in the range of "5:30:00" to "6:29:59" may be rounded to, and displayed as, "6" or as "Six" or as "Six O'clock" or as "6 AM" or as "6 PM"; and so forth.

In other embodiments, the rounding may be performed based on half-hour granularity or based on 30-minute resolution. For example, any time in the range of "4:15:00" to "4:44.59" may be rounded to, and displayed as, "4:30" or as "Half Past Four" or as "Four Thirty"; and any time in the range of "4:45:00" to "5:14.59" may be rounded to, and displayed as, "5" or "Five" or as "5 O'clock" or as "Five O'clock"; and that any time in the range of "5:15:00" to "5:44.59" may be rounded to, and displayed as, "5:30" or as "Five Thirty" or as "Half Past Five" or optionally as "5½"; and any time in the range of "5:45:00" to "6:14.59" may be rounded to, and displayed as, "6" or as "Six" or as "6 o'clock" or as "Six O'clock"; and so forth.

In other embodiments, the rounding may be performed based on quarter-hour granularity or based on 15-minute resolution. For example, any time in the range of "4:07:30" to "4:22:29" may be rounded to, and displayed as, "4:15" or as "Quarter Past Four" or as "4¼"; and any time in the range of "4:22:30" to "4:37.29" may be rounded to, and displayed as, "4:30" or as "Four Thirty" or as "Half Past Four" or as "4½"; and any time in the range of "4:37:30" to "4:52:29" may be rounded to, and displayed as, "4:45" or as "Quarter To Five" or as "4¾"; and any time in the range of "4:52:30" to "5:07.29" may be rounded to, and displayed as, "5" or as "Five" or as "Five O'clock"; and so forth.

In other embodiments, the rounding may be performed based on sixth-of-an-hour granularity or based on 10-minute resolution. For example, any time in the range of "4:05:00" to "4:14:59" may be rounded to, and displayed as, "4:10"; and any time in the range of "4:15:00" to "4:24:59" may be rounded to, and displayed as, "4:20"; and any time in the range of "4:25:00" to "4:34:59" may be rounded to, and displayed as, "4:30"; and any time in the range of "4:35:00" to "4:44:59" may be rounded to, and displayed as, "4:40"; and any time in the range of "4:45:00" to "4:54:59" may be rounded to, and displayed as, "4:50"; and any time in the range of "4:55:00" to "5:04:59" may be rounded to, and displayed as, "5" or as "5:00"; and any time in the range of "5:05:00" to "5:14:59" may be rounded to, and displayed as, "5:10"; and so forth.

In some embodiments, the digital watch may display the rounded horological information together with an indication that the displayed data is rounded and not necessarily reflecting the real time, and not simply truncated information. In some embodiments, the indication may be a particular character or string or word or phrase, for example, the word "approximately", a Tilde character, a double-Tilde character, a character indicating "almost equal to" or "generally equal to", or the like.

In some embodiments, the digital watch may be able to automatically and autonomously switch between: presenting rounded or "fuzzy" horological time which is different from the exact current time, and, presenting non-rounded exact current time. For example, the digital watch may determine the exact current time; then, if the exact current time is, for example, within 5 minutes of a whole hour of horological time (e.g., if the current time is "3:56"), then the digital watch may round the current time to the nearest whole hour and may present the rounded time instead of presenting the exact current time; whereas, if the exact current time is not within 5 minutes of a whole hour of horological time (e.g., if the current time is "3:43", then the digital watch may avoid the rounding process and may present the exact current time. In some embodiments, the presentation of either the rounded time or the exact current time may be performed on the same portion of the display of the digital watch, such that one type of time replaces the other type of time. In some embodiments, the determination which type of time to present in that screen-portion (namely, rounded time or exact time), and the switching from one type of presentation to the other and/or vice versa, may be performed autonomously and independently by the digital watch, without user intervention or without a user request or a user command to switch. In some embodiments, the user may set or modify the number of minutes (e.g., five minutes in this examples) indicating the difference between a current exact time and a whole hour, for which rounding of the time should or should not be performed by the digital watch; e.g., thereby setting the rounding granularity to be, for example, as low as four minutes or three minutes or two minutes or one minutes, or as high as six minutes, seven minutes, ten minutes, or other suitable user-defined values.

In some embodiments, the user may manually command the digital watch to switch from presenting the rounded time (e.g., "4") and the current exact time (e.g., "3:57"), and vice versa, for example, by pressing a button on the digital mode or by otherwise providing user input to the digital watch. Upon such user command, the digital watch may modify its operation accordingly, to continuously present either the rounded time or the exact time, based on the user's setting.

In some embodiments, based on a user command (e.g., by pressing a button on the digital watch, or a combination of buttons, or by otherwise providing user input to the digital watch), the digital watch may alternately present the rounded time and the exact non-rounded time, at the same screen-portion or in partially or wholly overlapping screen portion(s), such that each type of time appears for a particular time interval (e.g., three seconds) and is then automatically replaced by a display of the alternate type of time, and vice versa. For example, the user may set the digital watch to present the two types of time by alternating between them every four seconds. Accordingly, the digital watch may then present the rounded time (e.g., "4") in the center of the display panel, for four seconds; then, the digital watch may instantly replace the display of the rounded time with a display of the exact time (e.g., "3:57"), displayed at the same location of the display panel or at a location which partially or wholly overlaps with that location, for a period of four seconds; then again display the rounded time for four seconds, then the non-rounded time for four seconds, and so forth.

In some embodiments, the digital watch is able to correctly track and tell the current time, but the digital watch intentionally computes and displays a false or fake or unreal time, which corresponds to a rounded version of the real current time, instead of presenting the real current time; in order to facilitate the reading, comprehending and/or utilization of the horological time by the user, which may be, for example, a child or a person with disability or a person with special needs.

In some embodiments, even a typical user may enjoy or may appreciate a digital watch which actively displays fake or unreal horological information which slightly differs from the real horological time, based on rounding of the time, thereby requiring less effort from the user to read the time and comprehend it. For example, in some embodiments, even a sophisticated user who is able to fully read and comprehend an exact time string in the format of "3:58:47" or in the format "3:58", may enjoy and may benefit from reading, instead, a rounded time of "4" or of "4:00" even if it differs from the current exact time which the user typically relies on. Such user enjoyment may include, for example, reduced strain on the user's eyes and/or brain to observe, read, process and/or comprehend the time; an increased ability to remember, after a few seconds or after a few minutes, what is the approximately time (since it may be easier to remember the observed "4" rather than a conventionally observed "3:57" or "3:57:46"); an increased efficiency to provide a response, or an ability to provide a quick response, to a clock-less passer-by or friend or co-worker who asks to know what the time is.

In some embodiments, even a typical user or a sophisticated user may enjoy or may benefit from a digital watch which displays a time value which updates—due to the rounding of the displayed time—less frequently than the updating of the display of a conventional watch or clock (which is once per second or once per minute). For example, some users may be more comfortable with a watch or clock which updates its display only once-per-hour, or twice-per-hour, or four-times per hour; and this result may be achieved by the rounding mechanism of some embodiments.

In some embodiments, a user may prefer or enjoy the rounded time due to various circumstances or environmental constraints which allow him only a brief period of time to look at the watch or clock, to read the time and/or to comprehend it. In a demonstrative example, a driver of a vehicle may drive on the highway, and may wish to take his eyes off the road in order to glimpse at his wristwatch to learn the time; however, such use may require a longer period of time to observe, to read and/or to comprehend a time string of "3:57" or "3:57:46", and may require a shorter period of time to observe and/or read and/or comprehend a simplified, rounded, display of "4" or "4:00" or "4 PM", even though the exact real time is actually "3:57" or "3:57:46", respectively. The reduced speed and effort required by the driver, to look at his watch while driving the vehicle, corresponds to reduced strain and mental effort for the driver, and also translates directly into an increase in safety by allowing the driver to take a shorter-than-conventional look at his watch and move his eyes back to the road.

In another demonstrative example, a user may sleep in bed at 2:57 AM, and may be slightly disturbed by a noise of a passing ambulance. The user may wish to glimpse at the digital clock located on the night-stand next to her bed. A conventional digital watch would show her the exact current time, for example, as "2:57" or "2:57 AM"; whereas the digital clock in accordance with some embodiments would display to her simply "3" or "3:00" or "3 AM", thereby providing her with sufficient information while reducing the strain on her eyes and brains and while allowing her to avoid completely waking up in order to read and comprehend a longer time string corresponding to the exact real time. In some embodiments, the digital clock may be pre-programmed by the user, such that in certain time-slot(s) during a day (e.g., from 6 AM until midnight) the digital clock displays non-rounded real time; whereas during other certain time slot(s) (e.g., from midnight until 6 AM) the digital clock displays rounded time, for example, in order to allow the user to quickly read and comprehend the rounded time at night-time while the user sleeps in bed and only glimpses towards the digital clock.

In some embodiments, the digital watch may be beneficial or advantageous to a tourist or immigrant or emigrant or visitor, who comes to the United States of America, from a foreign country which utilizes numerals (namely, symbols representing numbers) that are different from those utilized in the United States of America. For example, a person from an Arab country may be very familiar with Arabic numerals, but not familiar or less familiar with the numerals utilized in the United States of America (which are sometimes referred to as "West Arabic" numerals); or similarly, a person may be familiar with Bangla or Bengali numerals, or Chinese numerals, or Devanagari numerals, or Classical Greek numerals, or Malayalam numerals, or Phoenician numerals, or Roman numerals, or Suzhou numerals, or Tamil numerals, or Thai numerals, or the like. Such person may not entirely master the reading and/or comprehension of long strings of Western numerals (e.g., "3:57" or "3:57:28"), but may have sufficient knowledge of the Western numerals which may allow him to read and comprehend numbers in the range of 1 to 12, thereby sufficing for him to know the rounded time while utilizing the digital watch of some embodiments. The rounded, and thus simplified, horological information displayed by the digital watch in some embodiments may therefore be sufficiently comprehendible to such person who may not adequately master the Western numerals.

In some embodiments, the digital watch may be more user-friendly or child-friendly or child-oriented, relative to a conventional digital watch or even relative to a conventional child-oriented digital watch. Some embodiments include features and functionalities which actively teach away from conventional digital watches. In the field of digital watches and gadgets for children, there is a clear trend to manufacture and direct to children gadgets and digital watches which overload the child with information, features, and horological information that is hard-to-read (for a child) and/or difficult to comprehend (for a child). In contrast, some embodiments provide a digital watch or digital clock which presents to the child the time, substantially continuously, using a single integer in the range of 1 to 12, for example, the "rounded" hourly time, thereby providing to the child (or to an adult user) the most-significant component of the horological information in a clear and concise manner, free of less-significant horological information or rapidly-changing horological information which obscures the most-significant portion of the horological information (namely, the hours or the rounded hours) or burdens a user who attempts to read and comprehend the time. Conventional digital watches follow a trend of over-loading the child with features, and are greatly influenced by the plethora of features that adult-oriented electronic devices (e.g., iPhone, iPod Touch, iPad, Blackberry) provide to adult users; and therefore, the conventional trend is to use a conventional digital watch as a platform to flood the child with complex and non-useful components of the horological information, together with additional features—such as playback of audio/video, or games—which contribute to further obscure the most significant portion of the time. In contrast, some embodiments provide reduced-complexity and increased-readability horological information.

In some embodiments, since the digital watch may be able to present rounded horological information, a reduced-number of LCD components, or "display segments", or pixels, may be required in order to provide horological information; thereby allowing, for example, reduction in cost of the digital watch (or an apparatus including the digital watch), reduction in size of the digital watch (or an apparatus including the digital watch), a reduction in electronic components (e.g., LED units), a reduction in power consumption (e.g., due to the reduced number of LEDs illuminated) and a "greener" device or more environmentally-friendly device, or the like. In some embodiments, for example, the digital watch may present the rounded horological time by displaying only a single integer in the range of 1 to 12, corresponding to the nearest (rounded) horological hour; such that both "4:32" and "5:29" (as well as "4:32:47" and "5:29:17") are rounded to a reduced-complexity "5" horological information, which requires less pixels, LCD components, LEDs, or other components for presentation. For example, in some embodiments, two numeric characters may suffice for presenting horological information (e.g., or "11"); whereas a conventional digital watch may require four numeric characters and a separator (e.g., "10:56") or six numeric characters and two separators (e.g., "10:56:37"). In some embodiments, two components of seven-segment display may suffice to present the hour-rounded horological time. In some embodiments only eight LCD or LED segments may be required to present the hour-rounded horological time; for example, one single elongated segment on the left side may provide a display of the number "1" which may be a part of "10" or "11" or "12", accompanied on its right side by a seven-segment display component able to display each one of the integers in the range of 1 to 9 and also zero; thereby utilizing only eight illumination segments to fully represent the (hourly-rounded) horological information.

Some embodiments teach away from conventional digital watches, which demonstrate a clear trend of continuously attempting to show over-accurate and ultra-accurate horological information. For example, some conventional watches include a stop-watch mechanism able to measure and display tenths-of-a-second (1/10 of a second) and hundreds-of-a-second (1/100 of a second); or a synchronization mechanism able to periodically inquire with a remote source, through a wired link or a wireless link or a cellular communication signal, and the remote source—which may be equipped with an ultra-accurate atomic-clock—may provide synchronization information attempting to cause the digital watch to show more-accurate horological information. These features demonstrate a clear trend of making and utilizing digital watches which attempt to be more and more accurate, and attempt to provide increasingly-accurate horological information or increased-accuracy horological information. In contrast, some embodiments provide a digital watch or clock able to intentionally provide reduced-accuracy horological information, or even "fake" or rounded horological information, in order to convey to the user only the most-significant component of the horological information, and to remove from the user's field-of-view and train-of-thought the less-significant components of the horological information.

In some embodiments, the digital watch may track and determine the real time; and may display to the user a rounded time which may often differ from the real current time. In some embodiments, the difference between the displayed rounded time and the real current time may be, for example, at least one minute; at least two minutes; at least three minutes; at least four minutes; at least five minutes; at least six minutes; at least seven minutes; at least eight minutes; at least nice minutes; at least ten minutes; at least fifteen minutes; at least twenty minutes; at least 28 minutes; at least 29 minutes; at least 60 seconds; at least 61 seconds; at least 62 seconds; at least 90 seconds; at least 120 seconds; at least 121 seconds; at least 150 seconds; at least 151 seconds; at least 180 seconds; at least 181 seconds; at least 240 seconds; at least 241 seconds; at least 300 seconds; at least 301 seconds; or the like. In some embodiments, the difference between the displayed rounded time and the real current time may be, for example, at most one minute; at most two minutes; at most three minutes; at most four minutes; at most five minutes; at most six minutes; at most seven minutes; at most eight minutes; at most nice minutes; at most ten minutes; at most fifteen minutes; at most twenty minutes; at most 28 minutes; at most 29 minutes; at most 60 seconds; at most 61 seconds; at most 62 seconds; at most 90 seconds; at most 120 seconds; at least 121 seconds; at most 150 seconds; at most 151 seconds; at most 180 seconds; at most 181 seconds; at most 240 seconds; at most 241 seconds; at most 300 seconds; at most 301 seconds; or the like.

Some embodiments may include a digital watch or a digital wrist-watch able to calculate and display the rounded time and/or the rounded hour-component of horological information. Some embodiments may include not only a digital watch or wristwatch, but also, or alternatively, a digital clock, a portable clock, a non-portable clock, a fixed clock, a wearable clock or watch, a non-wearable clock or watch, a clock or watch able to operate using Direct Current (DC) power and/or Alternating Current (AC), a clock or watch able to operate using an internal power source, a clock or watch able to operate using an external or remote power source, a clock or watch which may be wired or may include a power cord or power cable, a wireless clock or watch, a clock or watch intended to be placed on a shelf or on a night-stand, a clock or watch intended to be affixed to or hanged on or glued to or otherwise connected to a wall or furniture, or the like. For demonstrative purposes, portions of the discussion, in the text and/or the drawings, may relate to a "digital watch" or to a "digital wristwatch", yet some embodiments may include other types of watches, clocks, and time-telling components or devices or systems.

Reference is made to FIG. 1, which is a schematic illustration of a digital watch 100 in accordance with some demonstrative embodiments. Digital watch 100 may include, for example, a case 101 or other housing able to hold or enclose therein one or more electronic components of the digital watch 101. The case 101 may be made of, for example, plastic, rubber, metal, a combination of materials, water-resistant material(s), pressure-resistant material(s), shock-resistant material(s), or the like.

Digital watch 100 may optionally include a band 104 or wrist-band to allow a person to wear the digital watch 100 around the person's wrist. The band 104 may be made of, for example, leather, cloth, nylon, polyester, metal, plastic, rubber, or other suitable materials. Optionally, the band 104 may include an opening/closing mechanism to allow a person to put on the digital watch 100 on his wrist and/or to remove the digital watch 100 from his wrist; for example, a belt-resembling mechanism having one or more buckles and/or holes and/or hooks, a male/female mechanism, a knotting mechanism, a Velcro mechanism, a Velcro hooks mechanism, a Velcro loops mechanism, a fabric having miniature hooks-and-loops fasteners, a button mechanism, lace(s), or other suitable mechanisms.

Digital watch 100 may optionally include one or more buttons 103 to allow a person to set and/or modify the operation and/or functionality of digital watch 100. For example, the one or more buttons 103 may allow a person to set or modify the current time; to set or modify the current date; to set or modify the current day-of-week; to set or modify alarm or alert functionality; to operate a stop-watch function; to illuminate the digital watch or its display; or the like. In some embodiments, one or more buttons 103 may be used; in other embodiments, additionally or alternatively, other interface components may be used to allow a person to provide input to the digital watch, for example, a touch-screen, a multi-touch screen, a scroll-wheel, a touch-pad, a joystick, a trackball, a mouse, a stylus, a slider, a button which is accessible by a finger or by a fingernail or only by a sharp object (e.g., a pen or a needle), or the like. In some embodiments, other suitable types of user interfaces may be used, for example, an interface allowing the digital watch 100 to receive input using wired links and/or wireless links, an interface allowing the digital watch 100 to receive input using speech uttered by a user (e.g., using a microphone to capture audio and a speech recognition module to recognize a command from the captured audio), an interface able to recognize gestures of a user, or the like.

Digital watch 100 may further include a display 102, which may be embedded with the case 101, or may be otherwise held by case 101 or by other housing or enclosure. Display 102 may be able to present horological information, on a continuous basis and/or upon demand by a user. In some embodiments, display 102 may be able to substantially continuously display horological information which may be, or may include, rounded horological information, for example, at least a rounded value of the real-time hour information.

As shown in FIG. 1, display 102 may present an indication 151 of rounded hour horological information, e.g., "3", if the current real time is actually 2:57 or 2:56 or 3:04 or the like. The real time is not displayed in the display 102, thereby facilitating the ability of a user—such as a child or a person with certain disability—to rapidly read and/or comprehend the time, or the most-significant horological component, rounded.

Figure 2:
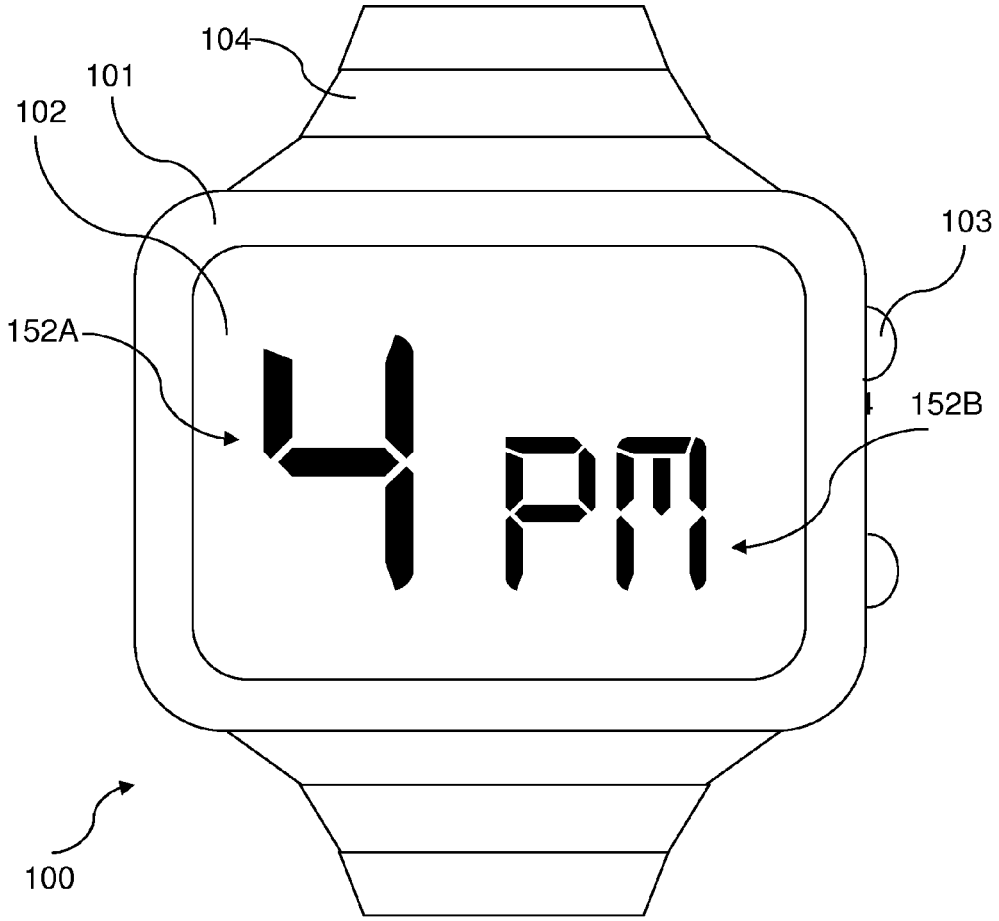

Reference is made to FIG. 2, which is a schematic illustration of digital watch 100 in accordance with some demonstrative embodiments. Display 102 may present an indication 152A of rounded hour information (e.g., "4"), accompanied by an indication 152B of either "AM" or "PM" associated with the rounded hour information.

Figure 3:
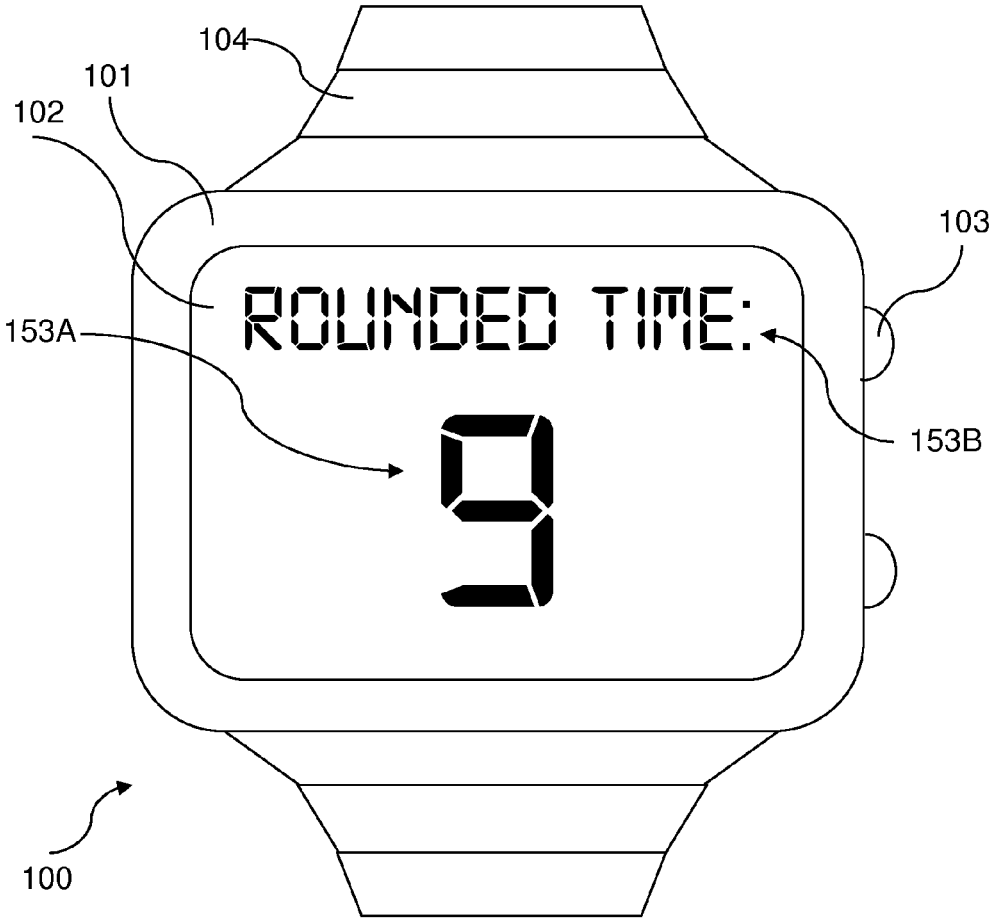

Reference is made to FIG. 3, which is a schematic illustration of digital watch 100 in accordance with some demonstrative embodiments. Display 102 may present an indication 153A of rounded hour information (e.g., "9"), accompanied by an indication 153B indicating that the presented time is rounded time or rounded hourly time (e.g., a "Rounded Time" label or a "Rounded Hourly Time" label).

Figure 4:
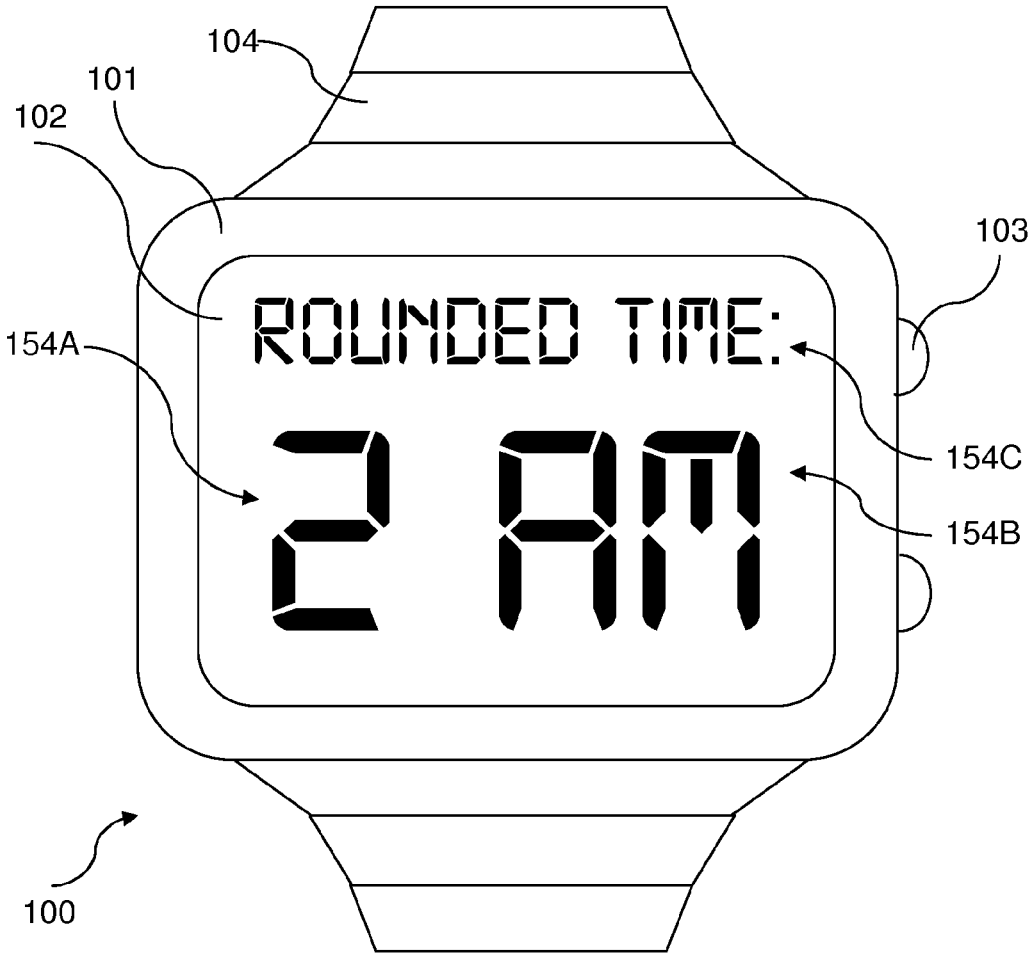

Reference is made to FIG. 4, which is a schematic illustration of digital watch 100 in accordance with some demonstrative embodiments. Display 102 may present an indication 154A of rounded hour information (e.g., "2"), accompanied by an indication 154B indicating that the presented time is rounded time or rounded hourly time (e.g., a "Rounded Time" label or a "Rounded Hourly Time" label); and further accompanied by an indication 154C of either "AM" or "PM" associated with the rounded hour information.

Figure 5:
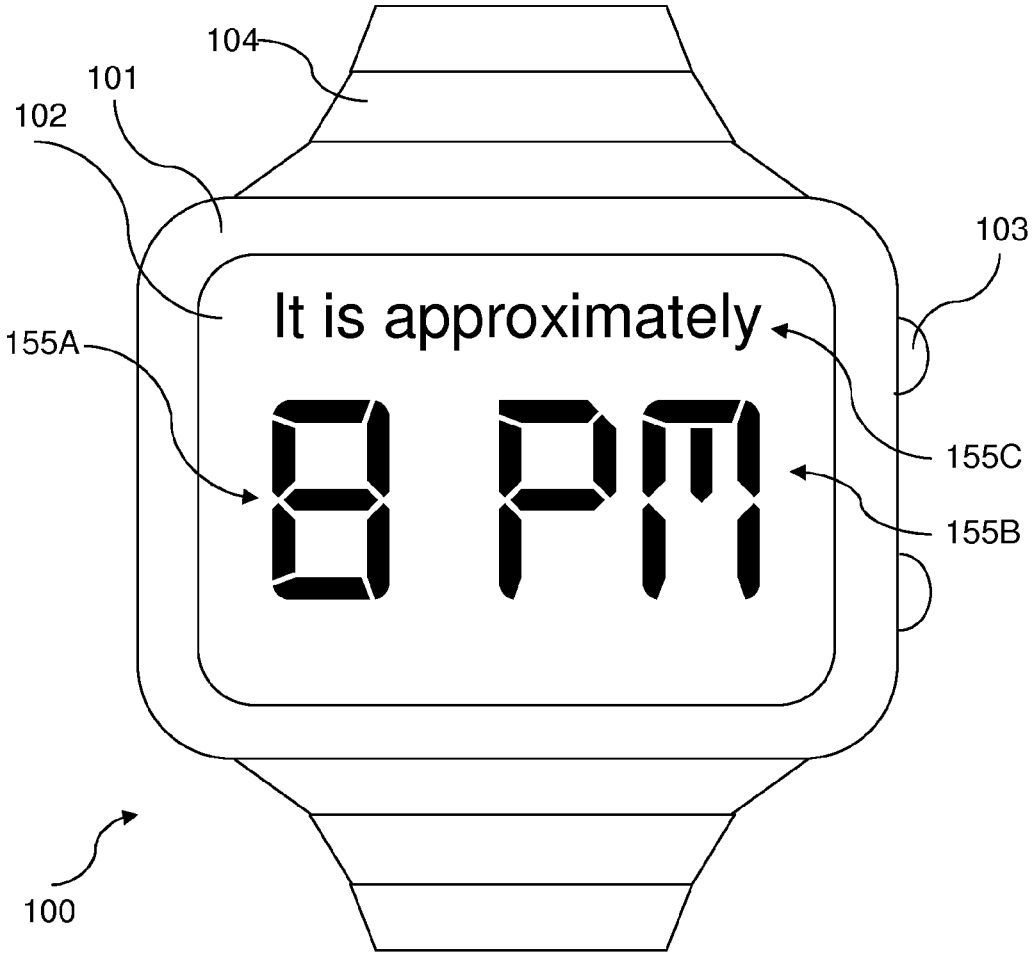

Reference is made to FIG. 5, which is a schematic illustration of digital watch 100 in accordance with some demonstrative embodiments. Display 102 may present an indication 155A of rounded hour information (e.g., "8"); accompanied by an indication 155B of either "AM" or "PM" associated with the rounded hour information; and further accompanied by an indication 155C alerting the user to the fact that the presented time is rounded time or rounded hourly time (e.g., a label reading "It is approximately", located above the rounded horological information).

Figure 6:
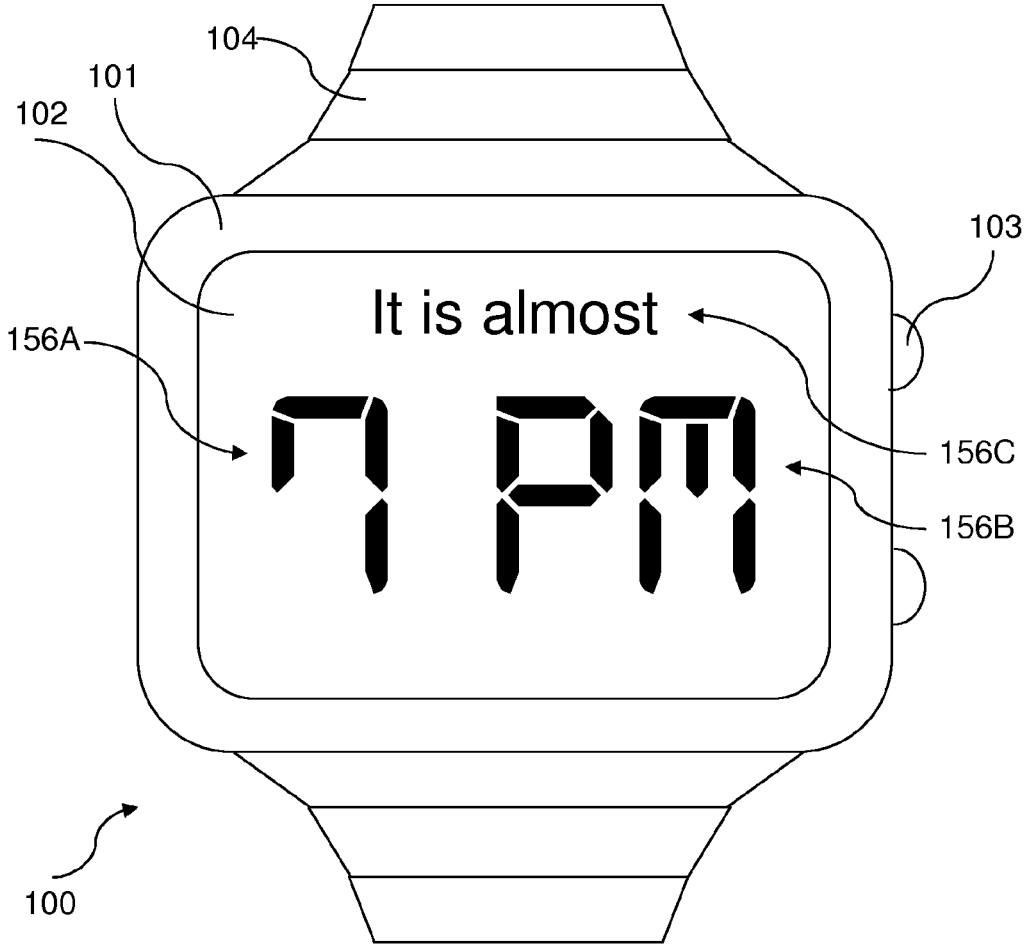

Reference is made to FIG. 6, which is a schematic illustration of digital watch 100 in accordance with some demonstrative embodiments. Display 102 may present an indication 156A of rounded hour information (e.g., "7"); optionally accompanied by an indication 156B of either "AM" or "PM" associated with the rounded hour information; and further accompanied by an indication 156C alerting the user to the fact that the presented time is rounded time or rounded hourly time and that the current real time is behind the displayed rounded time, e.g., using the label indicator "almost" or other suitable indicator (e.g., a label reading "It is almost", located above the rounded horological information).

Figure 7:
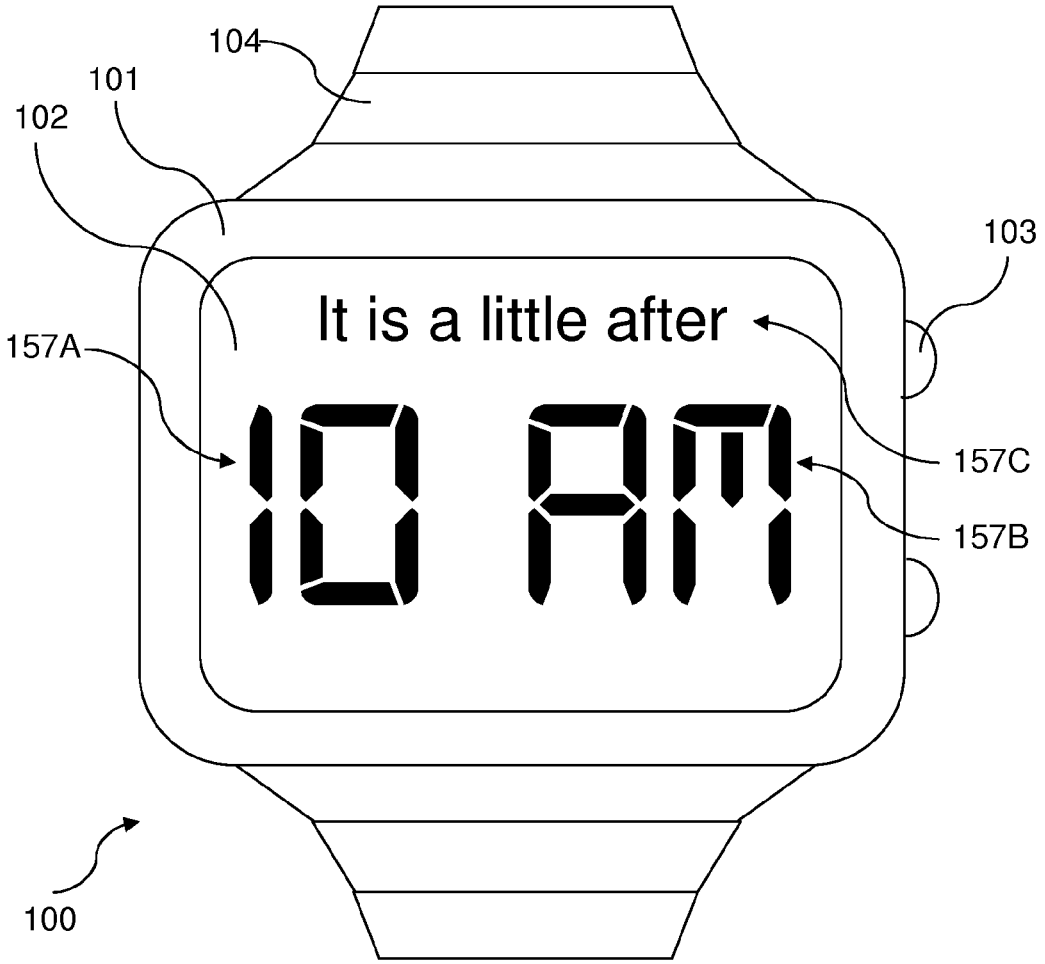

Reference is made to FIG. 7, which is a schematic illustration of digital watch 100 in accordance with some demonstrative embodiments. Display 102 may present an indication 157A of rounded hour information (e.g., "10"); optionally accompanied by an indication 157B of either "AM" or "PM" associated with the rounded hour information; and further accompanied by an indication 157C alerting the user to the fact that the presented time is rounded time or rounded hourly time and that the current real time is ahead of the displayed rounded time, e.g., using the label indicator "after" or "slightly after" or "a little after" or other suitable indicator (e.g., a label reading "It is a little after", located above the rounded horological information).

Figure 8:
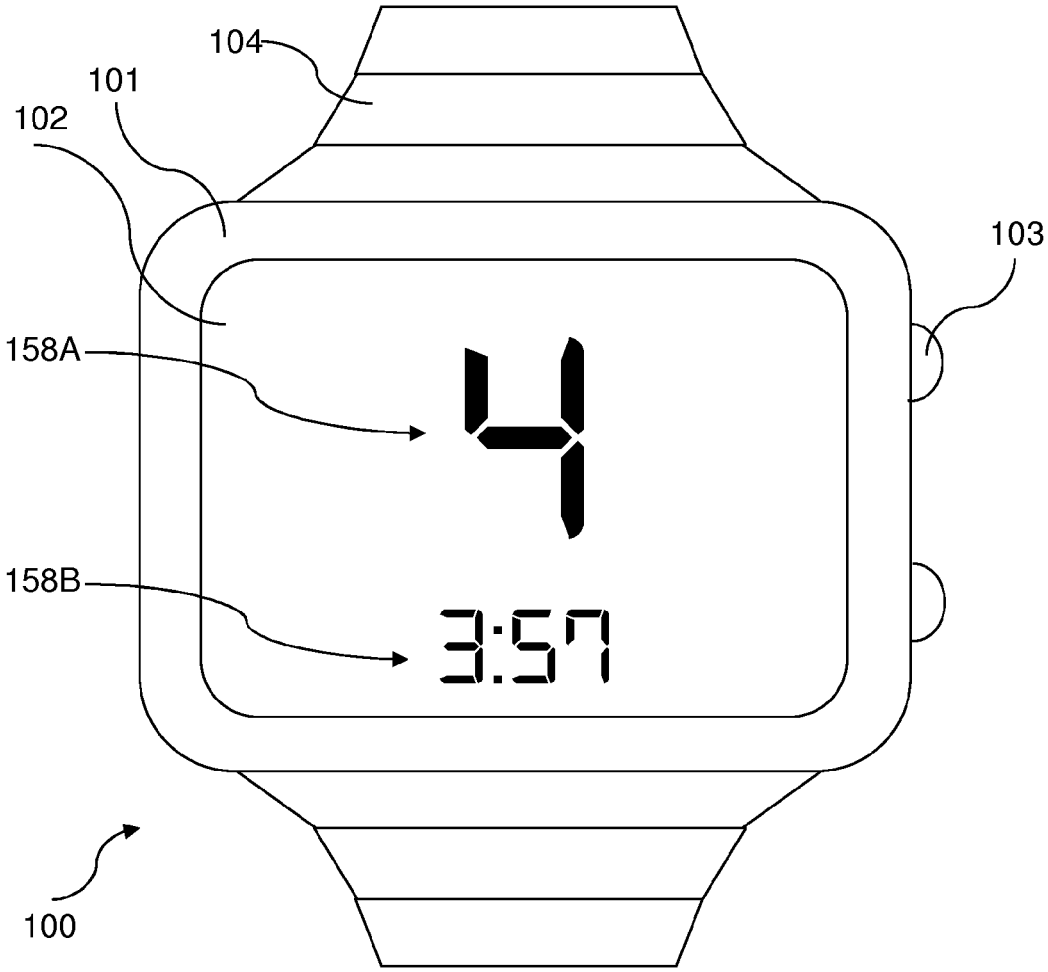

Reference is made to FIG. 8, which is a schematic illustration of digital watch 100 in accordance with some demonstrative embodiments. Display 102 may present an indication 158A of rounded hour information (e.g., "4"); optionally accompanied by an indication 158B of the current non-rounded real time (e.g., "3:57"). Optionally, an indicator of "AM" or "PM" may accompany the rounded hour information; and/or, optionally, an indicator of "AM" or "PM" may accompany the current non-rounded real time. In this demonstrative example, the indication 158B of the current real time includes a non-rounded hour component, and a minutes component.

Figure 9:
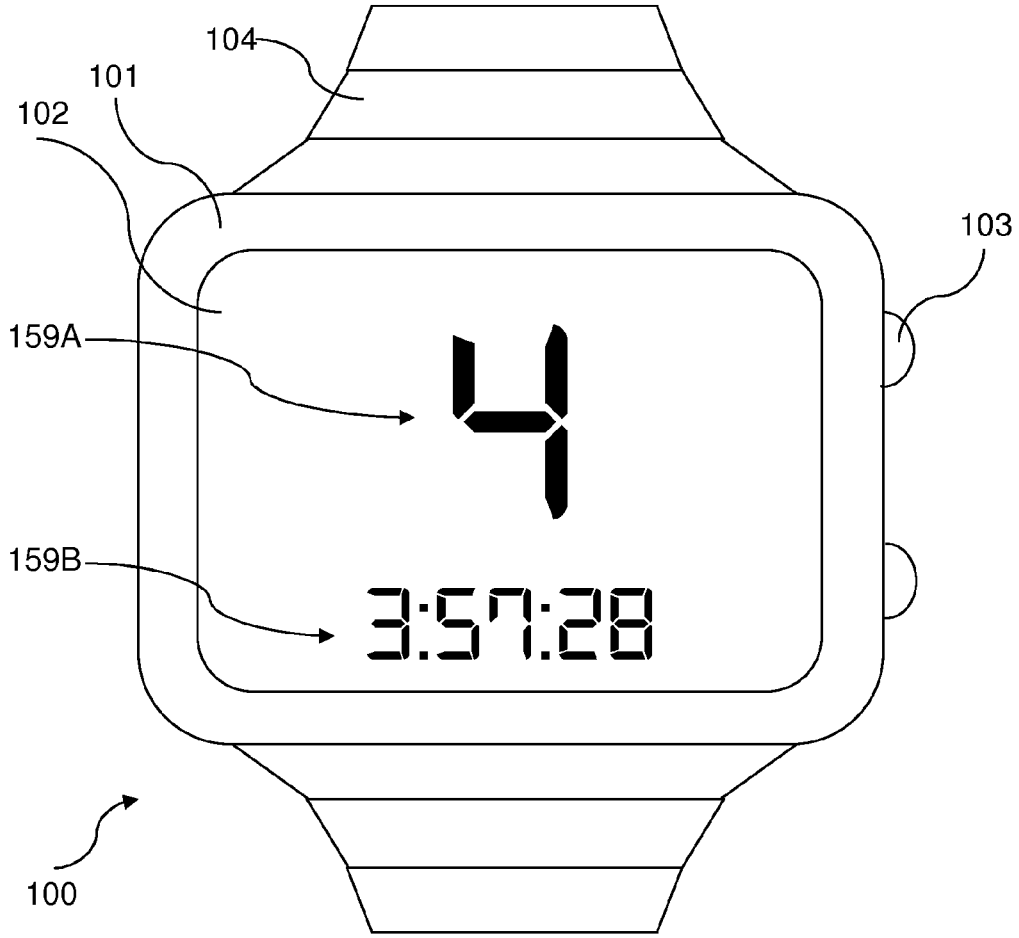

Reference is made to FIG. 9, which is a schematic illustration of digital watch 100 in accordance with some demonstrative embodiments. Display 102 may present an indication 159A of rounded hour information (e.g., "4"); optionally accompanied by an indication 159B of the current non-rounded real time (e.g., "3:57:28"). Optionally, an indicator of "AM" or "PM" may accompany the rounded hour information; and/or, optionally, an indicator of "AM" or "PM" may accompany the current non-rounded real time. In this demonstrative example, the indication 159B of the current real time includes a non-rounded hour component, a minutes component, and a seconds component.

Figure 10:
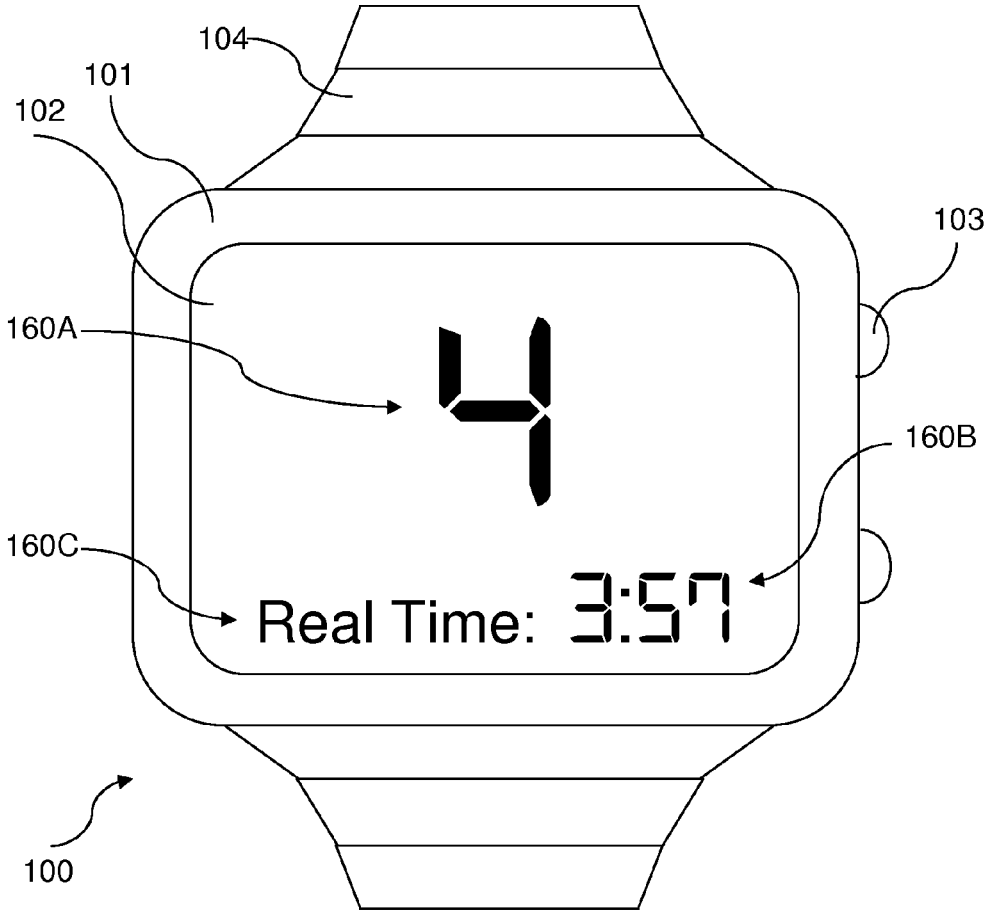

Reference is made to FIG. 10, which is a schematic illustration of digital watch 100 in accordance with some demonstrative embodiments. Display 102 may present an indication 160A of rounded hour information (e.g., "4"); optionally accompanied by an indication 160B of the current non-rounded real time (e.g., "3:57"). Optionally, an indicator of "AM" or "PM" may accompany the rounded hour information; and/or, optionally, an indicator of "AM" or "PM" may accompany the current non-rounded real time. Furthermore, an indicator 160C (e.g., a label reading "Real Time:") may accompany or precede the current real time, to convey to the user that the indication 160B represents the current real time.

Figure 11:
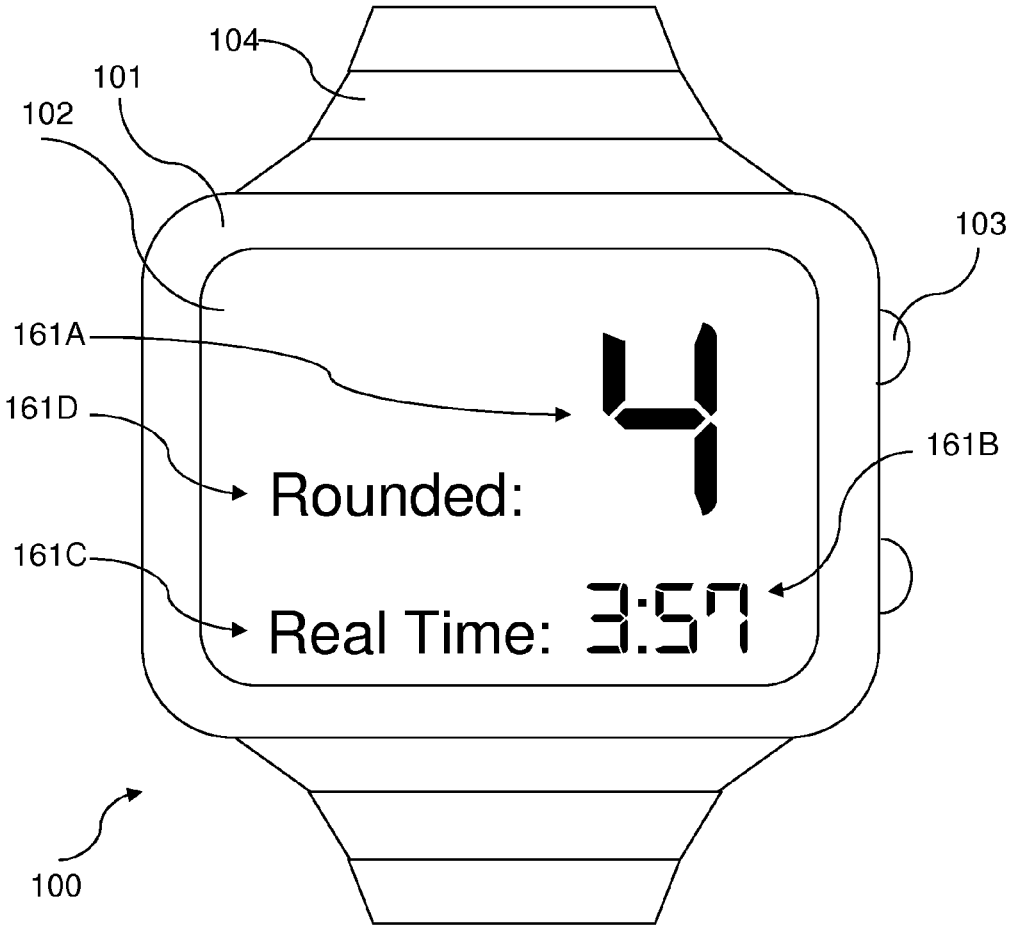

Reference is made to FIG. 11, which is a schematic illustration of digital watch 100 in accordance with some demonstrative embodiments. Display 102 may present an indication 161A of rounded hour information (e.g., "4"); optionally accompanied by an indication 161B of the current non-rounded real time (e.g., "3:57"). Optionally, an indicator of "AM" or "PM" may accompany the rounded hour information; and/or, optionally, an indicator of "AM" or "PM" may accompany the current non-rounded real time. Furthermore, an indication 161C (e.g., a label reading "Real Time:") may accompany or precede the current real time, to convey to the user that the indication 161B of the current real time indeed represents the current real time. Additionally, an indication 161D (e.g., a label reading "Rounded Time:" or "Approximate Time:" or a Tilde character) may accompany or precede the rounded time, to convey to the user that the indication 161A represents the rounded time and not the exact current time.

Figure 12:
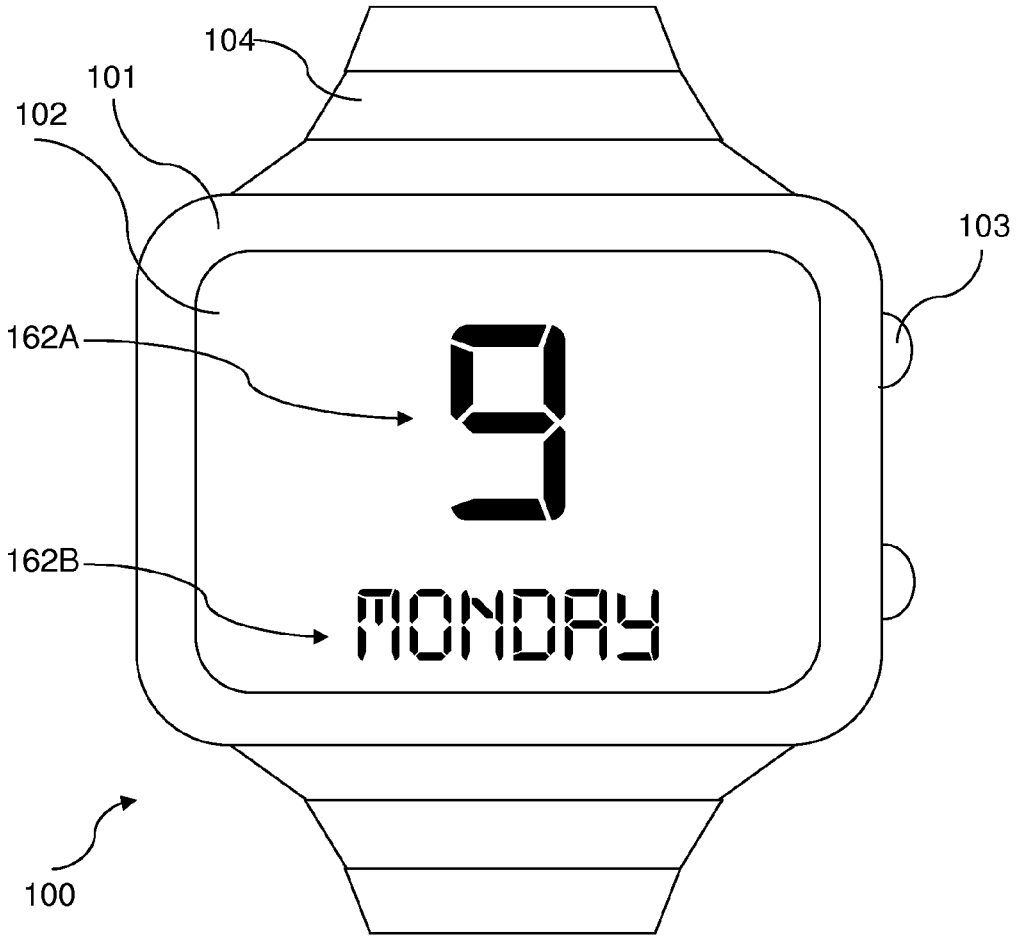

Reference is made to FIG. 12, which is a schematic illustration of digital watch 100 in accordance with some demonstrative embodiments. Display 102 may present an indication 162A of rounded hour information (e.g., "9"); optionally accompanied by an indication 162B of the current day-of-week (e.g., "Monday" or "Mon" or "Mo", if the day-of-week is a Monday). Optionally, an indicator of "AM" or "PM" may accompany the rounded hour information.

Figure 13:
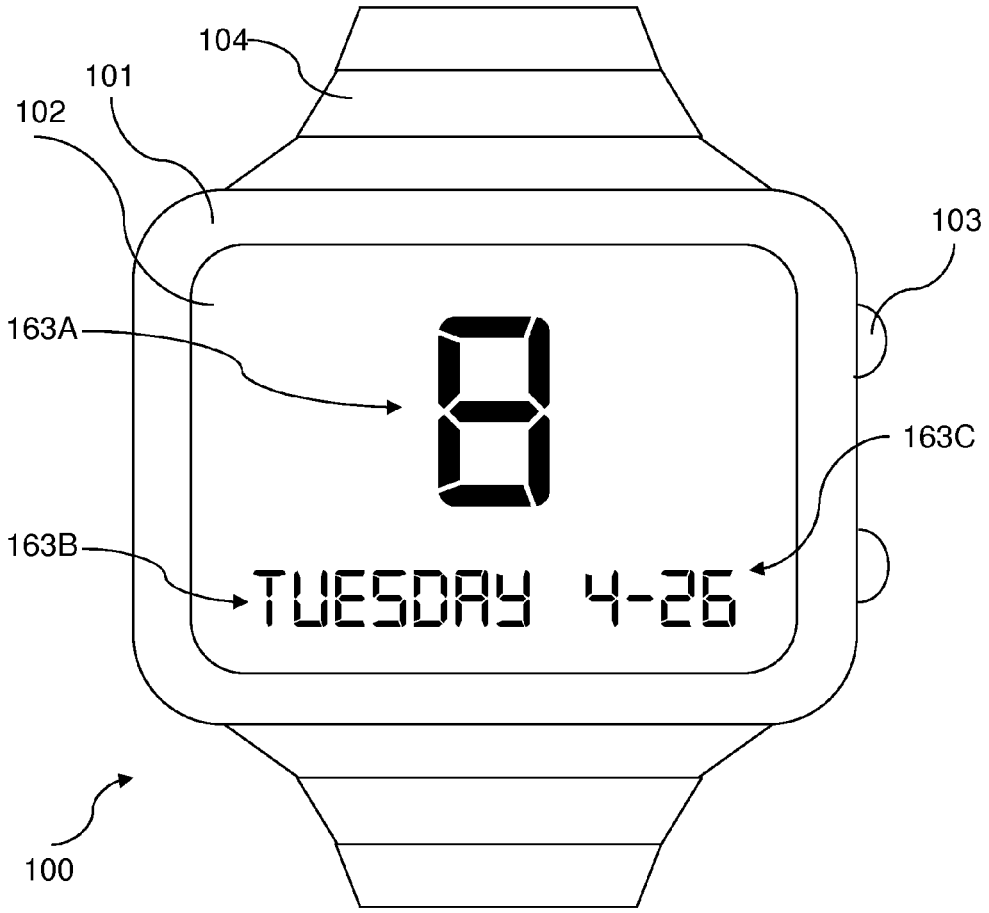

Reference is made to FIG. 13, which is a schematic illustration of digital watch 100 in accordance with some demonstrative embodiments. Display 102 may present an indication 163A of rounded hour information (e.g., "8"); optionally accompanied by an indication 163B of the current day-of-week (e.g., "Tuesday" or "Tue" or "Tu", if the day-of-week is a Tuesday); and further optionally accompanied by an indication 163C of the calendar date or a portion thereof (e.g., the string "4-26" if the current date is April 26; or the string "Apr. 26, 10" if the current date is Apr. 26, 2010). Optionally, an indicator of "AM" or "PM" may accompany the rounded hour information.

Figure 14:
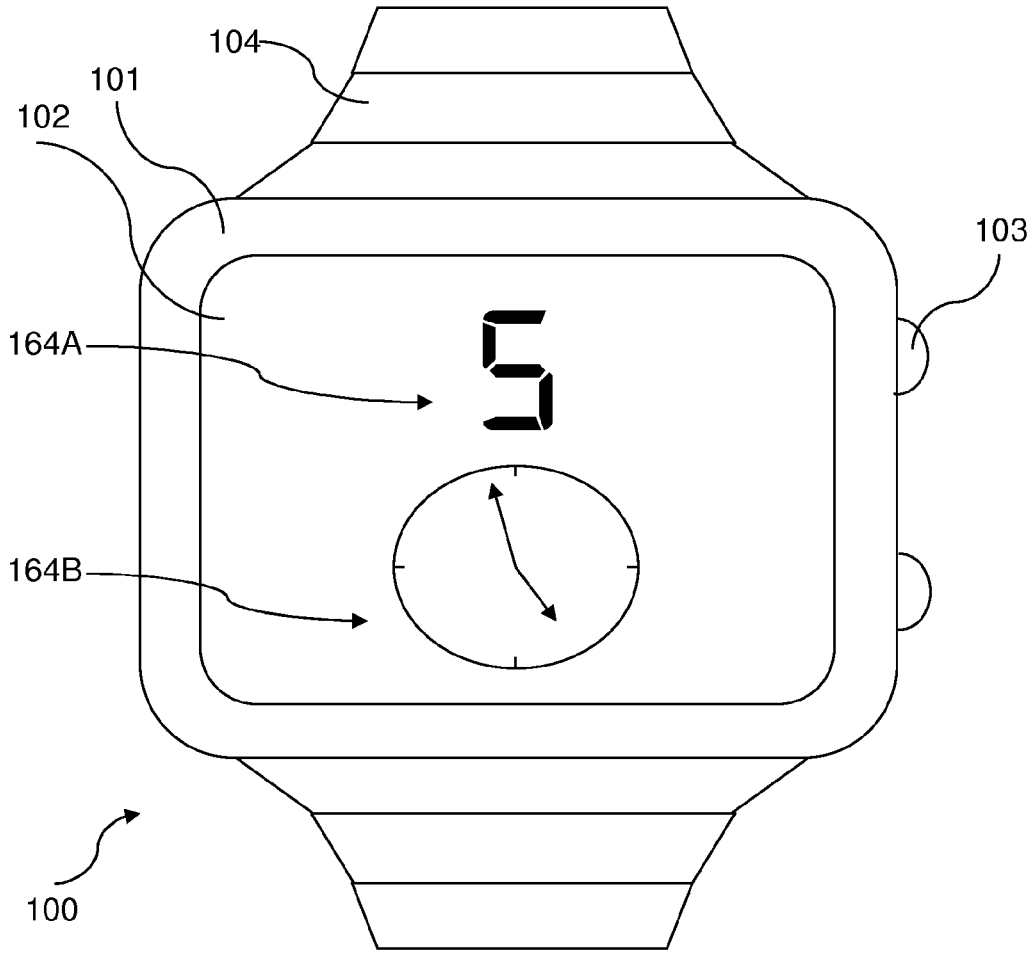

Reference is made to FIG. 14, which is a schematic illustration of digital watch 100 in accordance with some demonstrative embodiments. Display 102 may present an indication 164A of rounded hour information (e.g., "5"); and may be optionally accompanied by a digital depiction 164B of an analog clock showing the real current time (e.g., the real time of "4:58" using a hand for the hours and a hand for the minutes, and optionally using also a head for the seconds). Optionally, an indicator of "AM" or "PM" may accompany the rounded hour information. In some embodiments, the rounded time may be presented in a digital format, as shown in indication 164A; whereas the real time may be presented in a digital representation of an analog format, as shown in indication 164B. In other embodiments, the rounded time may be presented in a digital format, as shown in indication 164A; and also, the digital representation of the analog format may further be of the rounded time and not of the real time, such that indication 164B may, in some embodiments, show a digital rendering of an analog format of the rounded time "5" even though the current real time is 4:58.

Figure 15:
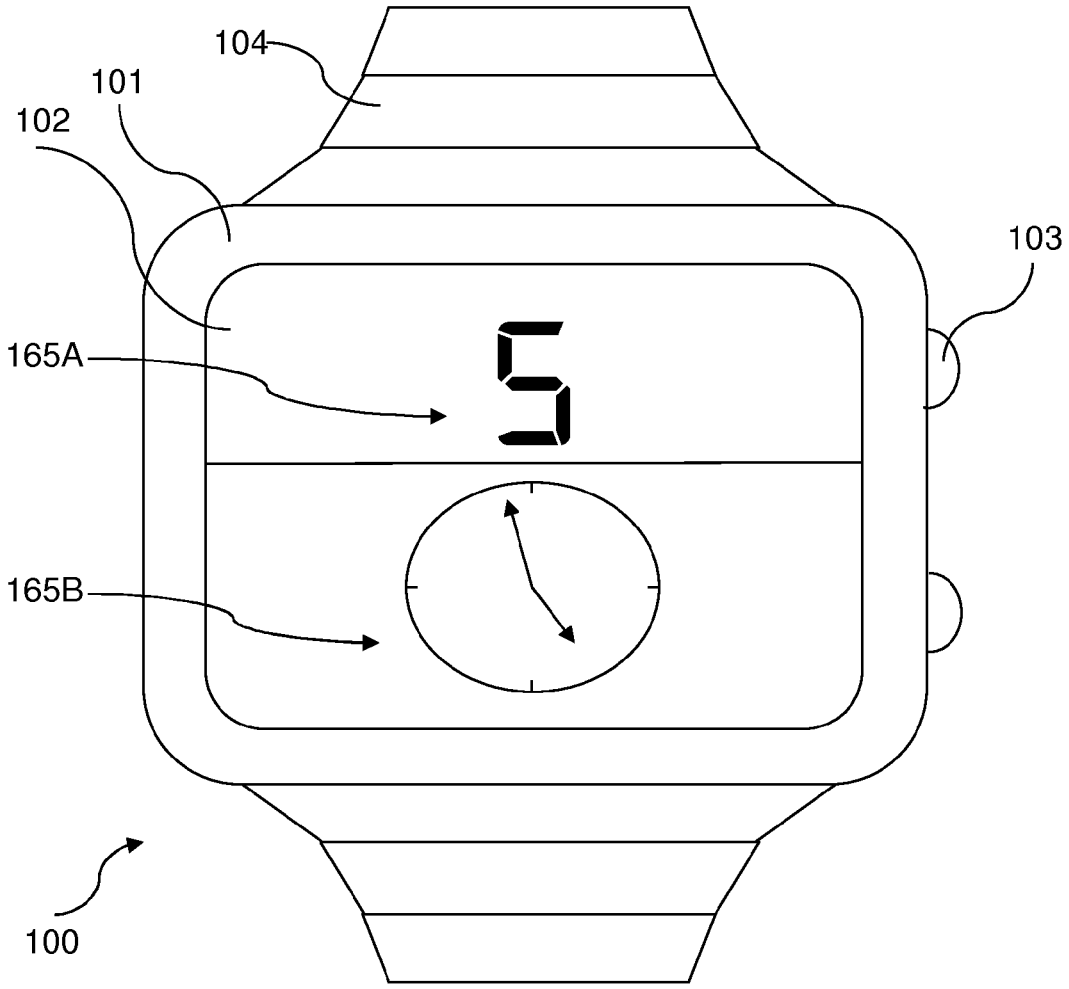

Reference is made to FIG. 15, which is a schematic illustration of digital watch 100 in accordance with some demonstrative embodiments. Display 102 may present an indication 16BA of rounded hour information (e.g., "5"). Optionally, an indicator of "AM" or "PM" may accompany the rounded hour information. In proximity to display 102, for example, on the face of digital watch 100 and under the display 102 or above it, the digital watch 100 and/or the case 101 may further include an analog clock 165B (namely, a mechanical analog clock, and not a digital representation of an analog time format) which shows the real current time (e.g., using a hand for the hours and a hand for the minutes, and optionally using also a hand for the seconds). Accordingly, the digital watch 100 may thus provide digital horological data in which at least the hour component is rounded and does not necessarily correspond to the current real time; as well as analog representation of the real current time using a built-in analog clock.

Figure 16:
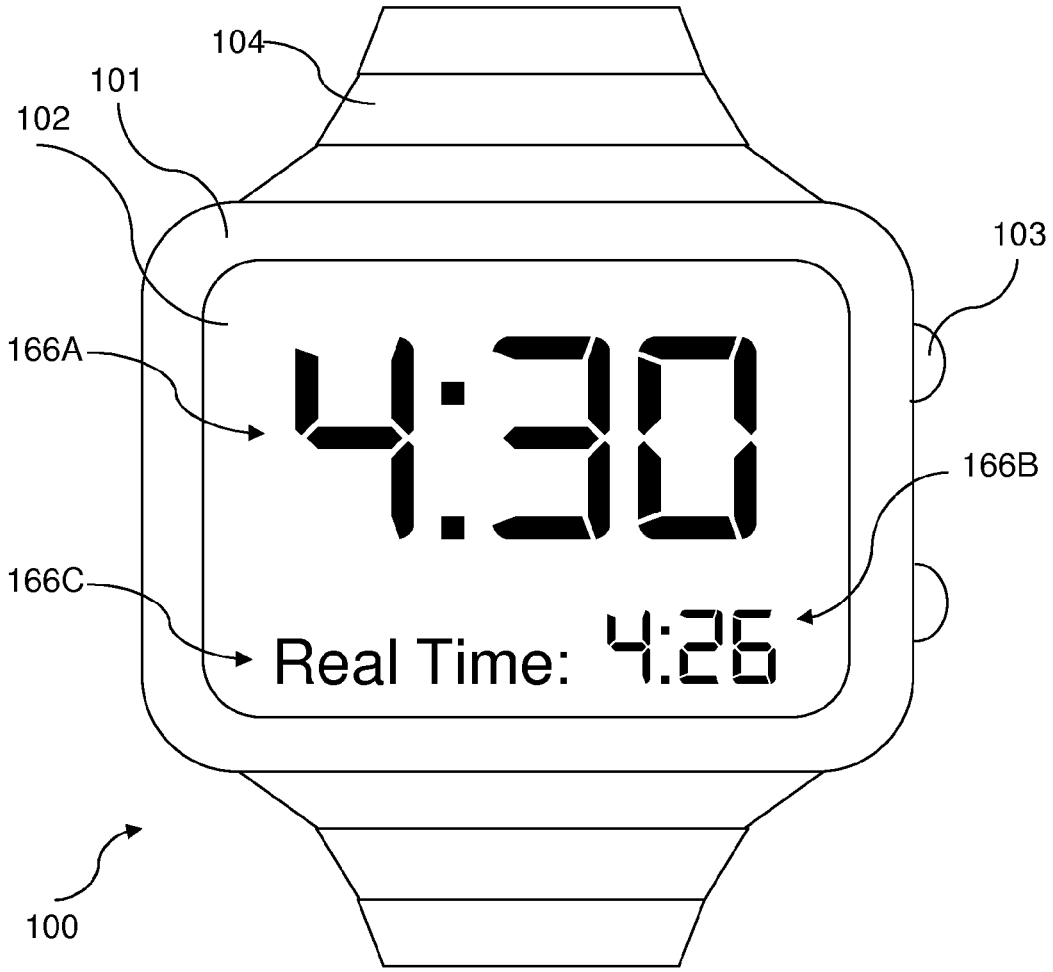

Reference is made to FIG. 16, which is a schematic illustration of digital watch 100 in accordance with some demonstrative embodiments. Display 102 may present an indication 166A of rounded horological information (e.g., "4:30") which is rounded based on 30-minutes intervals or half-hour intervals (e.g., rounded to either a whole horological hour, or to half an hour past a whole horological hour); optionally accompanied by an indication 166B of the current non-rounded real time (e.g., "4:26"). Optionally, an indicator of "AM" or "PM" may accompany the rounded horological information; and/or, optionally, an indicator of "AM" or "PM" may accompany the current non-rounded real time. Furthermore, an indicator 166C (e.g., a label reading "Real Time:") may accompany or precede the current real time, to convey to the user that the indication 166B represents the current real time. It would be appreciated that the indication 166A of the rounded horological time (e.g., "4:30" in the shown example), does not reflect the real time or the exact time or the current time, and further, does not reflect merely a truncated or cropped version of the horological time (e.g., by merely truncating or removing the seconds information); but rather, reflect an intentionally false or fake or artificial value which corresponds to a rounded value of the horological time which is rounded (upward or downward) according to a preset rounding interval (e.g., 30 minutes in this example; or 15 minutes; or 10 minutes; or 5 minutes).

Figure 17A:
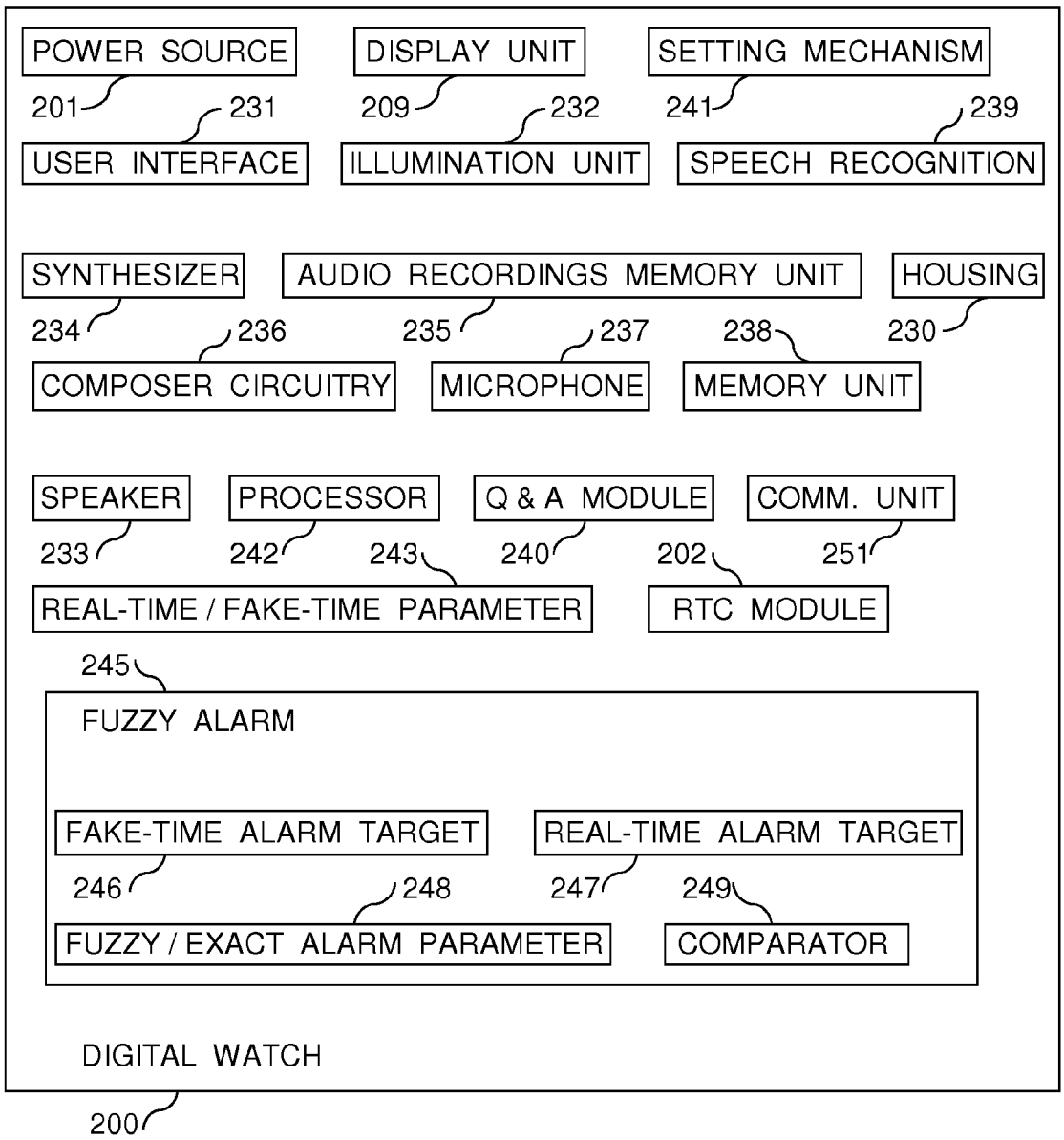
FIG. 17A is a schematic block diagram illustration of a digital watch in accordance with some demonstrative embodiments.
Figure 17B:
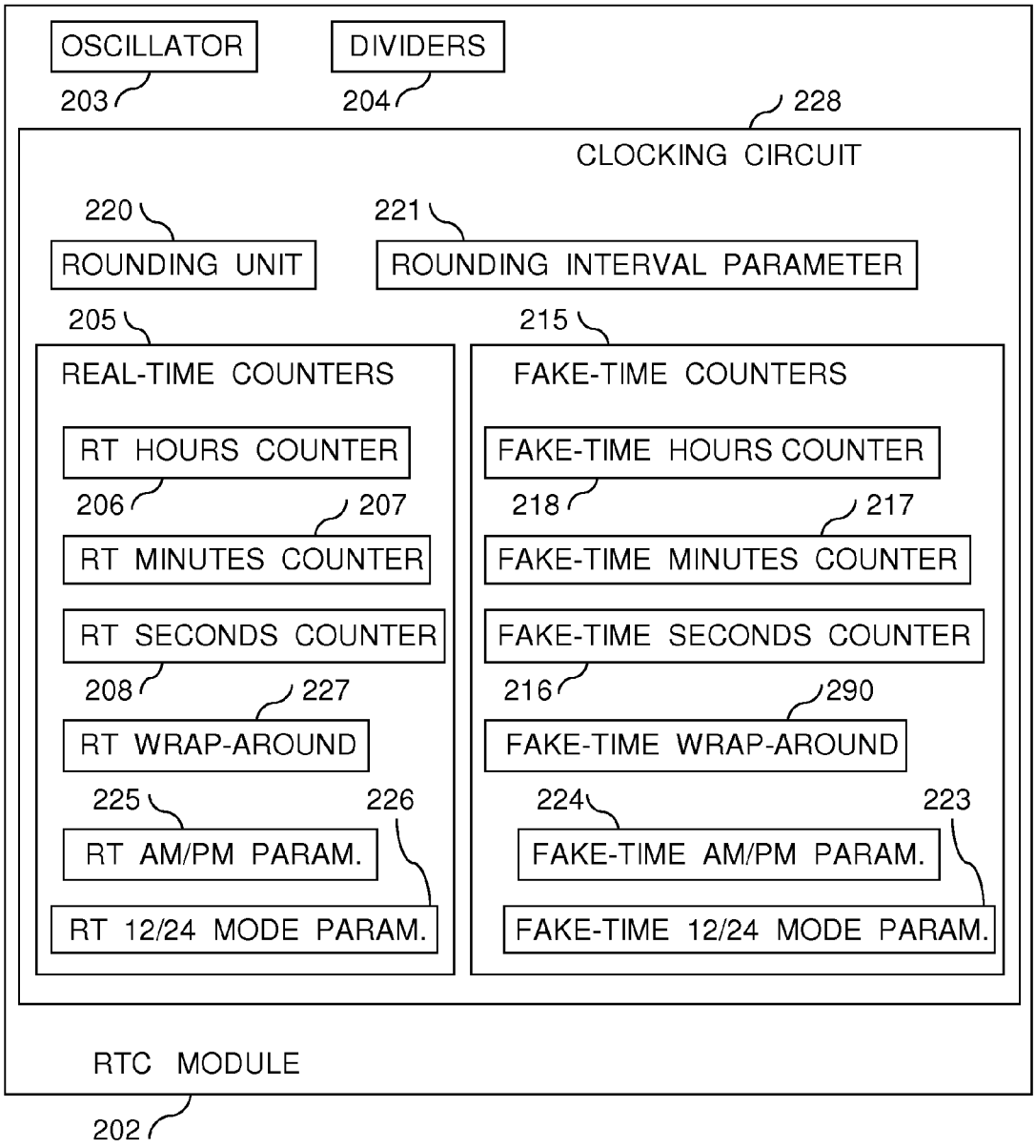
FIG. 17B is a schematic block diagram illustration of a Real-Time Clock (RTC) module in accordance with some demonstrative embodiments.
Figure 18:
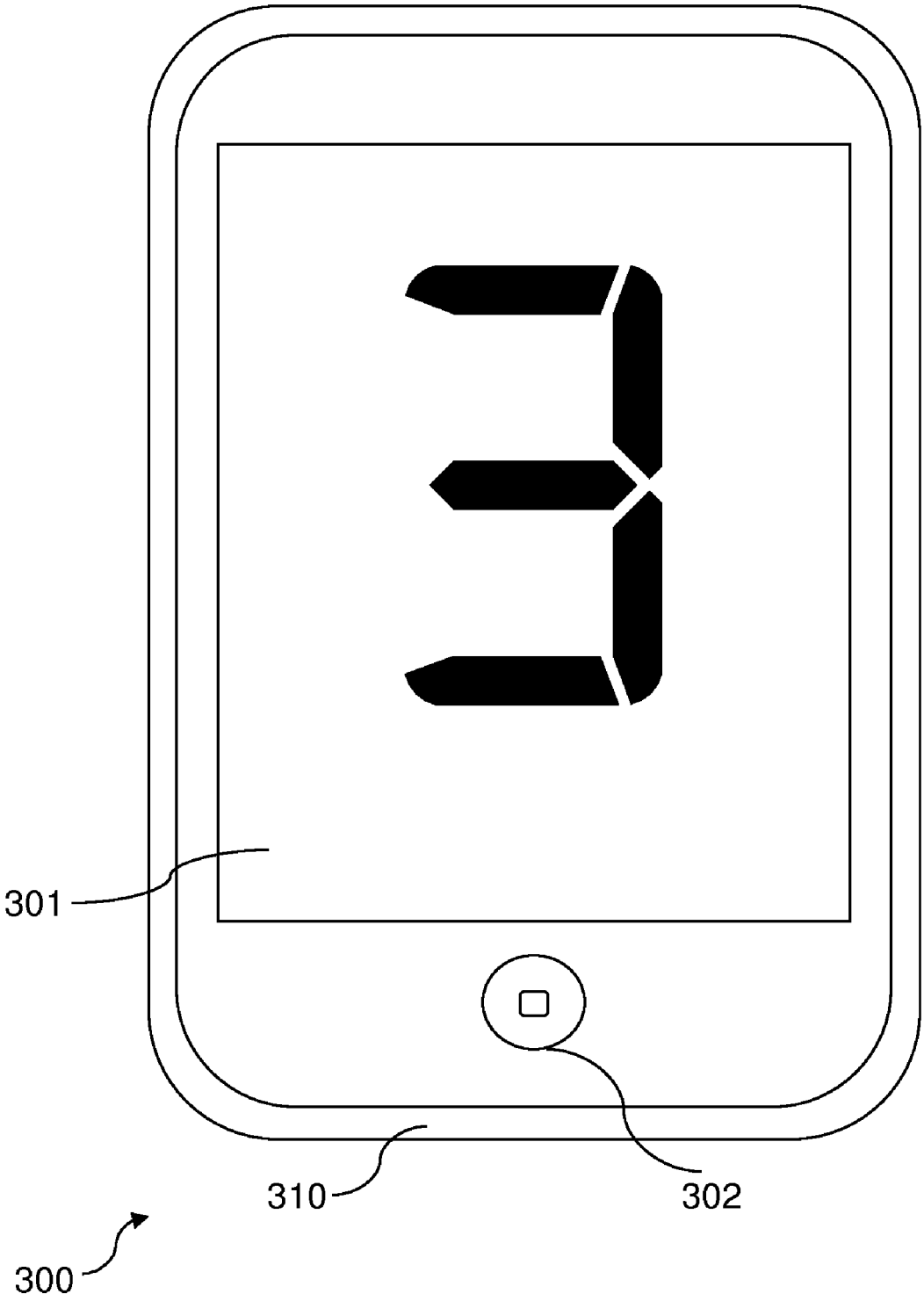
FIGS. 18-21 are schematic illustrations of an electronic device incorporating a digital watch in accordance with some demonstrative embodiments.
Figure 19:
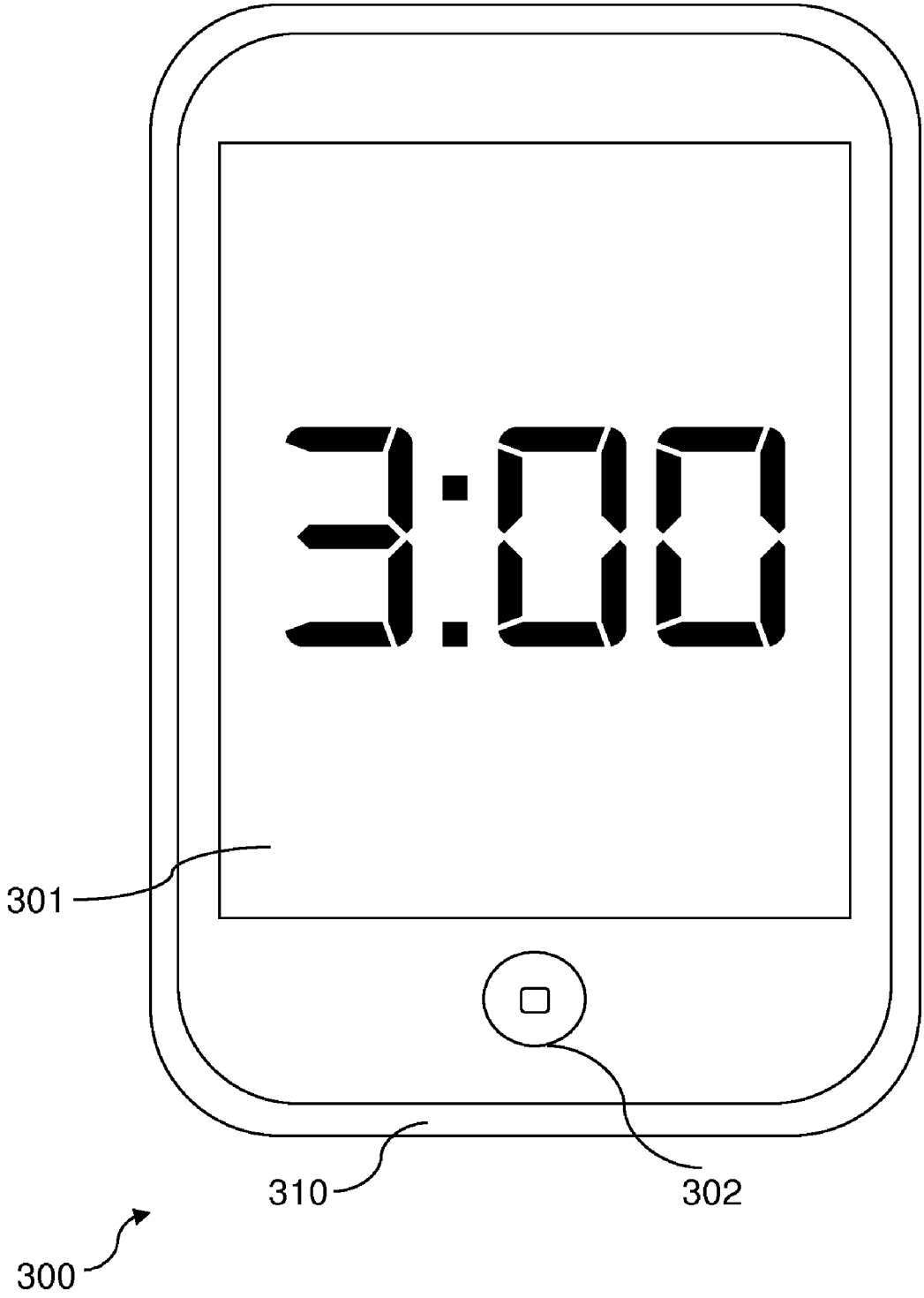
Figure 20:
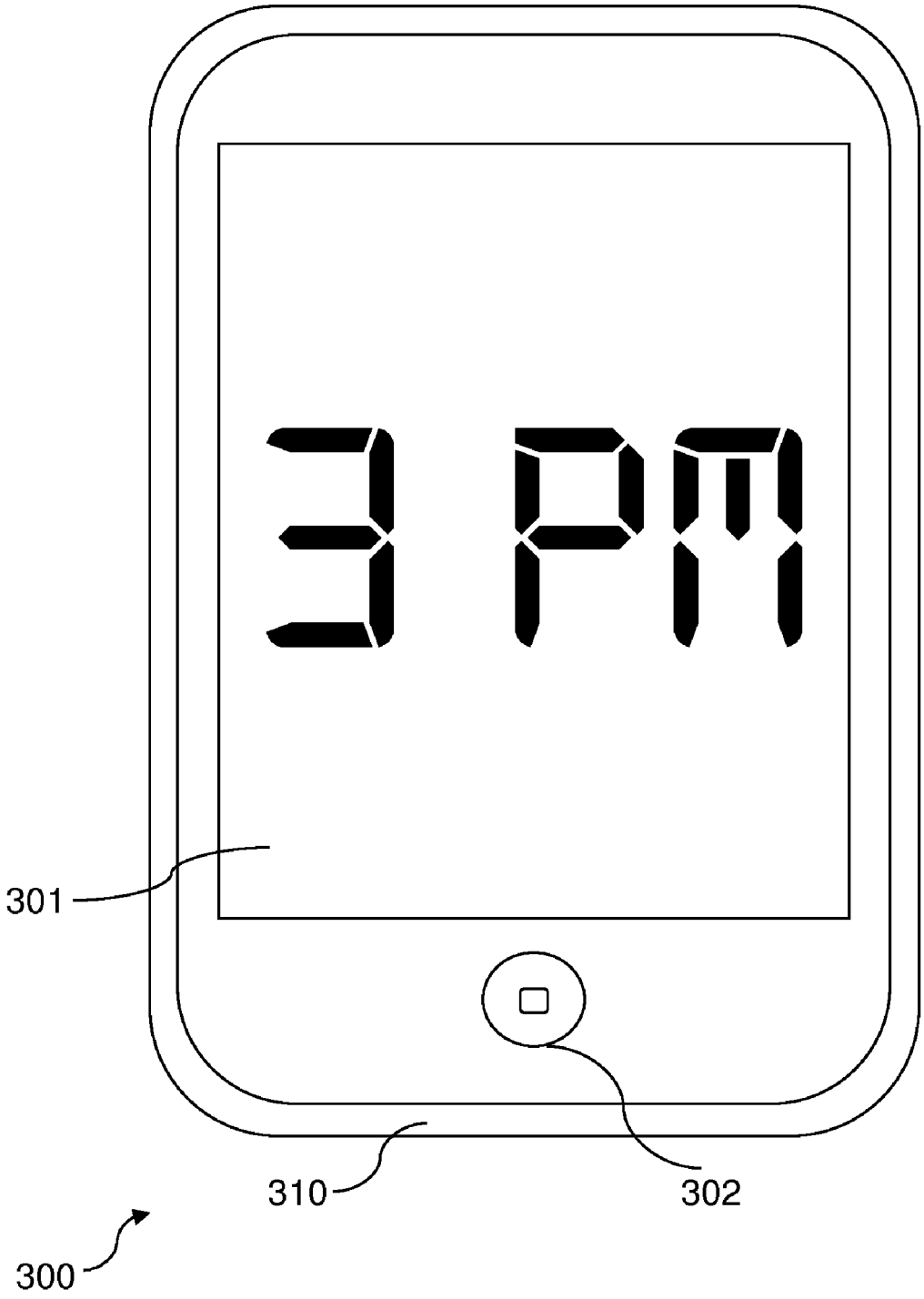

Reference is made to FIG. 17A, which is a schematic block diagram illustration of a digital watch 200 in accordance with some demonstrative embodiments; and to FIG. 17B, which is a schematic block diagram illustration of a Real-Time Clock (RTC) module 202 in accordance with some demonstrative embodiments. Digital watch 200 and/or its components and/or its functionalities may be similar, for example, to the corresponding digital watch 100 of FIGS. 1 to 16 and/or its components and/or functionalities, respectively. In some embodiments, digital watch 200 of FIG. 17A may include and/or utilize the RTC module 202 of FIG. 17B, or other suitable modules or circuits. In some embodiments, the RTC module 202 of FIG. 17B may be used in digital watch 200 of FIG. 17A, or in other suitable digital watches, digital clocks, or electronic devices.

In some embodiments, digital watch 200 may include, for example, a power source 201 which may be internal to the digital watch 200, external to the digital watch 200, or partially internal and partially external to digital watch 200. In some embodiments, power source 201 may include, for example, a battery; multiple batteries; a rechargeable battery; a non-rechargeable battery; a removable battery; a non-removable battery; a Lithium-ion (Li-ion) battery; a Nickel Cadmium (NiCad) battery; an alkaline battery; a "button"-type battery; a Direct Current (DC) power source; an Alternating Current (AC) power source; an AC power source which is converted or transformed (e.g., using a transformer) to regulated DC power; a main battery and a backup battery; a set of two or more batteries or power sources, or the same types or of multiple types, operating in parallel or using a redundancy scheme or using a backup scheme or a stand-by scheme; or the like. In some embodiments, the power source 201 may include a component able to generate electric power and/or harvest electric power, for example, a unit able to harvest solar energy using one or more solar panels; a unit able to harvest electro-magnetic energy or ambient electro-magnetic energy or background energy or cosmic radiation; a unit able to harvest energy from movement of the human body and/or the digital watch; a unit able to harvest energy from vibrations or micro-vibrations of the digital watch and/or the human body; a unit able to harvest energy from acceleration or deceleration of the digital watch and/or of the user; a unit able to harvest energy from body heat or from changes in body heat or from sweat; a unit able to harvest energy from wind, from air-flow, from air movement, or from other environmental changes; or the like.

In some embodiments, digital watch 200 may further include a display 209 able to present numerals, text, alphanumeric information, ASCII characters, graphics, images, animation, or other visible information. In some embodiments, the display 209 may include, for example, a Liquid Crystal Display (LCD), a plasma display, a flat screen, a Light Emitting Diode (LED) based display, an Organic LED (OLED) based display, a backlit display, a seven-segment display, a display utilizing one or more seven-segment portions, a monochrome display, a black-and-white display, a grayscale display, a color display, a reflector-based display, a display including an array of pixels, a display including an array of pixels filled with Liquid Crystals (LCs) in front of a light-source or backlight or reflector, a Cathode Ray Tube (CRT) display, a passive display utilizing ambient light (e.g., sun-light or room lighting), an active display which may not require any ambient lighting, a passive matrix display, an active matrix display, a zero-power display, a bistable display, a zenithal bistable display, a display able to retain content or image or information without power, a zero-power LCD, a display similar to electronic paper, or the like.

In some embodiments, display 209 may be able to present horological information, on a continuous basis and/or upon demand by a user. In some embodiments, display 209 may be able to substantially continuously display horological information which may be, or may include, rounded horological information, for example, at least a rounded value of the real-time hour information.

In some embodiments, the digital watch 200 may further include a Real-Time Clock (RTC) module 202 or other suitable RTC component able to track passage of time and able to produce one or more signals corresponding to the current time. In some embodiments, for example, the RTC module 202 may include an oscillator 203 to generate and/or provide pulsing at a predetermined frequency; one or more dividers 204 to divide the original pulsing by suitable factor(s) in order to achieve the desired pulsing frequency (e.g., once per second, once per minute, once per hour), optionally associated with one or more Real Time (RT) counters 205 and/or other components of a clocking circuit 228 to count the elapsing seconds, minutes and hours and thereby produce the corresponding horological information of the current time. In some embodiments, for example, a 60-Hz signal may be extracted from a conventional power line (e.g., through a power cable to a wall socket). In other embodiments, the desired pulsing may be extracted by utilizing a crystal oscillator, for example, able to vibrate or resonate or pulse at exactly or approximately 32,768 Hz; by utilizing a set of dividers or toggles or switches or other suitable components, to generate a pulse per second. The elapsing pulses, at a rate of one pulse per second, are counted or tracked or accumulated by the RT counters 205.

In some embodiments, the RTC module 202 may include other suitable components and/or mechanisms, as known in the art, to ensure that the exact real time is tracked. For example, the RT counters 205 may include a real-time hours counter 206, a real-time minutes counter 207, and a real-time seconds counter 208; and each RT counter may be associated with circuitry or logic to ensure correct wrap-around of each counter, optionally implemented using a real-time wrap-around module 227 or other suitable wrap-around or rollover circuitry or logic. In some embodiments, for example, the RT seconds counter 208 may count from zero to 59, and may then wrap-around or reset to zero while causing a single increment in the value of the RT minutes counter 207. The RT minute counter 207 may count from zero to 59, and may then wrap-around or reset to zero while causing a single increment in the value of the RT hours counter 206. The RT hours counter 206 may commence at one, may increment to reach 12, and may then (instead of incrementing to reach 13) wrap-around to one, if the digital watch 200 is set to utilize a 12-hour time system or an AM/PM time format. Alternatively, the RT hours counter 206 may commence at zero, may increment to reach 23, and may then (instead of incrementing to reach 24) wrap-around to zero, if the digital watch 200 is set to utilize a 24-hour time system or a "military" notation time format. In some embodiments, a hard-coded or user-modifiable real time "12/24 mode" parameter 226, for example, a flag or binary bit or other binary parameter, may be set or modified, based on a user command, to indicate whether the digital watch 200 is to utilize 12-hour time format or 24-hour time format; and the valid range of the RT hours counter 206, as well as its wrap-around rules, may be determined and operated by the clocking circuit 228 in accordance with the user-selected format or by the mode of operation (namely, 12 hours or 24 hours per wrap-around) as indicated by the real-time "12/24 mode" parameter 226. In some embodiments, the wrap-around of the RT hours counter 206 may further cause a toggle or a switch of the binary value of a binary "AM/PM" parameter 225, indicating whether the RT time or the RT hours value is between midnight to noon (AM) or between noon to midnight (PM).

In some embodiments, optionally, other or additional RT counters 205 may be used in digital watch 200, for example, a day-of-week counter to count the seven days of the week (Sunday through Saturday) and then wrap-around; a day-of-month counter and a month-of-year counter, optionally associated with a lookup table or other logic which determines the number of days per particular month, after which a wrap-around may occur; a year counter, optionally associated with a lookup table or with logic to determine leap year and to control their affect on the number of days in February; or the like. In some embodiments, for example, the wrap-around of the hour counter in a 24-hour time-tracking format may cause an increment in the day-of-week counter and in the day-of-month counter; or, every other wrap-around of the hour counter in a 12-hour time-tracking format may cause an increment in the day-of-week counter and in the day-of-month counter; other suitable relations may be used among RT counters 205.

In some embodiments, the RT counters 205 store or represent data which corresponds to the current real time which is accurately measured, or is attempted to be accurately measured (e.g., due to small inaccuracy or degradation in the characteristics of components), by the clocking circuit 228. In some embodiments, this data may not be directly displayed to the user, or may not be displayed at all to the user, for example, in contrast to a conventional digital watch in which the content of similar RT counters, reflecting the real time measured, is either "dumped" onto a screen, or is associated with one or more LEDs or other display components which are suitable to convert such RT counter values to a digital display (e.g., a seven-segment display, utilizing a binary number to seven-segment display converter). In some embodiments, instead, the values represented by RT counters 205 are further automatically manipulated, converted or rounded to produce other values, rounded values, fuzzy values, simplified values, child-friendly values, or other types of fake values—which may then be presented to the user of the digital watch 200, instead of or in addition to presenting to the user the real time.

For example, in some embodiments, a set of one or more fake-time counters 215 may be used in parallel to the RT counters 205 which measure or track the real time. In some embodiments, the fake-time counters 215 may include only a fake-time hours counter 218 which stores, substantially at any given time, a value that equals to the rounding (and not merely truncating or cropping) of the value stored in the real-time hour counter 208. In some embodiments, the rounding may be performed by utilizing a rounding unit 220 or rounding circuitry or rounding module or rounding logic, which may convert the value in the real-time hours counter 208 into a fake-time hours value to be stored in the fake-time hours counter 218, based on the values of the RT counters 205; and optionally utilizing a hard-coded parameter or a user-modifiable parameter indicating a rounding interval 221. Similarly, the rounding unit 220 may convert the value in the real-time minutes counter 207 into a fake-time minute value to be stored in a fake-time minutes counter 217. Optionally, a fake-time seconds counter 216 may be used; although in some embodiments it may be omitted. Optionally, a fake-time wrap-around module 290 may be used (e.g., similar to the real-time wrap-around module 227); although in some embodiments it may be omitted.

In some embodiments, the rounding unit 220 may utilize, for example, a lookup table, a database, one or more equations or conversion formulas, a program code, or other suitable logic or module to perform the conversion.

In some embodiments, for example, the rounding of the real-time hours value may be performed using the following pseudo-code, denoted Code 1, which may be implemented as a program code or as an Integrated Circuit (IC) or an Application-Specific IC (ASIC) or other suitable circuitry:

Code 1

```
Let Fake_Hours = Real_Hours ;
Let Fake_Minutes = Real_Minutes ;
If Rounding_Interval = 60_Minutes then
  {
  If Real_Minutes >= 30 then
    {
    Let Fake_Hours = Real_Hours + 1 ;
    if Fake_Hours = 13 then Let Fake_Hours = 1 ;
    Transfer to display unit only the Fake_Hours value, not the Real_Hours value,
      not the Real_Minutes value, not the Fake_Minutes value ;
    }
If Rounding_Interval = 30_Minutes then
  {
  If Real_Minutes <15 then Let Fake_Minutes = 0 ;
  If Real_Minutes >= 15 and Real_Minutes < 45 then Let Fake_Minutes = 30 ;
  If Real_Minutes >= 45 then
    {
    Let Fake_Minutes = 0 ;
    Let Fake_Hours = Real_Hours + 1 ;
    if Fake_Hours = 13 then Let Fake_Hours = 1 ;
    }
  Transfer to display unit only the Fake_Hours value followed by the Fake_Minutes value,
      not the Real_Hours value, not the Real_Minutes value ;
  }
```

In the demonstrative example of Code 1, the pseudo-code is able to produce a rounded value of the fake-time hours counter 218. Code 1 begins by copying the real-time hours value from the real-time hours counter 206 to the fake-time hours counter 218; and by copying the real-time minutes value from the real-time minutes counter 207 to the fake-time minutes counter 217. Then, Code 1 continues to operate based on checking what rounding interval is currently being used, for example, as defined in the rounding interval parameter 221, such as, for example, 60 minutes rounding interval, 30 minutes rounding interval, 20 minutes rounding interval, 15 minutes rounding interval, 10 minutes rounding interval, 5 minutes rounding interval, or the like. For demonstrative purposes, only 60 minutes rounding interval and 30 minutes rounding intervals are shown to be handled in Code 1.

In the case of 60-minute rounding interval, Code 1 checks whether the value of the real-time minutes counter 207 is equal to or greater than 30. If the checking result is negative, then no rounding operation is performed. If the checking result is positive, then the fake-time hours counter 218 may be assigned a value which is equal to one plus the value of the real-time hours counter 206, thereby automatically storing in the fake-time hours counter 218 a rounded-up value of the real-time hours component—a feature that does not exist in any conventional digital watch or clock. This assignment of the increased value into the fake-time hours counter 218 may take place before (or well before, or minutes before, or between 1 to 30 minutes before) the real-time hours counter 206 itself is incremented by one. The assignment of the incremented value to the fake-time hours counter 218 may be accompanied by a safety check or a wrap-around check or an overflow check, to check and handle a possible wrap-around of the fake-time hours value, if needed (e.g., a new value of 13 becomes 1 in a 12-hour time regime; and a new value of 24 becomes 0 in a 24-hour time regime).

In the case of 30-minute rounding interval, Code 1 checks whether the value of the value of the real-time minutes counter 207 is smaller than 15; and if so, then the fake-time minutes counter 217 is assigned a value of zero, as a rounding (e.g., rounding down) of the real-time minutes value; while the value of the fake-time hours counter 218 is maintained unchanged. If the value of the real-time minutes counter 207 is equal to or greater than 15 and is also smaller than 45, then the fake-time minutes counter 217 is assigned a value of 30 (namely, the fake-time minutes value is rounded, either upward or downward, to half-past-the-hour); and the value of the fake-time hours counter 218 is maintained unchanged. If the value of the real-time minutes counter 207 is greater than 45, then two changes are performed: the fake-time minutes counter 217 is assigned a value of zero, and the fake-time hours counter 218 is assigned a value which equals to one plus the value of the real-time hours counter 206 (in order to round-up the fake-time hours to the closest whole hour); with a safety check or wrap-around check or overflow check, to wrap-around the fake-time hours counter 218, if needed (e.g., a new value of 13 becomes 1 in a 12-hour time regime; and a new value of 24 becomes 0 in a 24-hour time regime); and optionally, if such wrap-around is performed and the time regime is a 12-hour time regime, together with also toggling or switching a value of a fake-time "AM/PM" parameter 223.

As demonstrated in Code 1, the value of the rounding interval parameter 221 may be used to determine not only rules for rounding of real-time data into fake-time data, but also for determining how many data components, or which data components, to display on the display of the digital watch 200. For example, in some embodiments, a 60-minute rounding interval may cause the digital watch 200 to present only the fake-time hours value, without presenting any minutes information or seconds information (real or fake); whereas selection of a 30-minute rounding interval may cause the digital watch 200 to present both the fake-time hours value and the fake-time minutes value (either continuously, or, only when the fake-time minutes value is other than zero).

In some embodiments, Code 1 or a similar code may be executed, for example, substantially every second; substantially once-per-minute; substantially twice-per-minute; substantially once per five minutes; substantially once per ten minutes; substantially once per twenty minutes; substantially once per thirty minutes; substantially once per sixty minutes; or at other suitable rate or frequency. In some embodiments, Code 1 may be executed substantially continuously, e.g., similar to a background process or an Operating System process or a kernel process. In some embodiments, Code 1 may be executed exactly once, or exactly twice, within per time period which equals to the rounding interval. For example, if the rounding interval is 60 minutes, then Code 1 may be executed once per 60 minutes, or twice per 60 minutes; whereas, if the rounding interval is 30 minutes, then Code 1 may be executed once per 30 minutes, or twice per 30 minutes; thereby reducing the required number of times that Code 1 needs to be executed, and thereby reducing processing power.

In some embodiments, a rounding interval of 30 minutes may cause the digital watch 200 to present fake-time in the format of, for example, "3:00", then "3:30", then "4:00", then "4:30", then "5:00", and so forth; whereas in other embodiments, a rounding interval of 30 minutes may cause the digital watch 200 to present fake-time in the format of, for example, "3", then "3:30", then "4", then "4:30", then "5", and so forth. In some embodiments, the existence of a rounding interval, or the value of the rounding interval 221, may cause the digital watch to automatically present the time using a first format (e.g., only "4") at a first time-point, and to automatically present the time using a second format (e.g., "4:30") at a second time-point, wherein the first and second time-points are not more than 61 minutes apart.

Similar code or pseudo-code or coding portions may be used to handle rounding of horological information using other values of rounding interval 221. Other suitable types of codes may be used, for example, a code which operates recursively or iteratively, or a code which includes re-usable functions to round a particular counter, or a code which includes re-usable functions to check and/or handle wrap-around of a particular counter. In some embodiments, the code may check whether the rounding of a particular counter affects one or more other counters, and may update them if needed; for example, as demonstrated in Code 1 with regard to the rounding-up of the minutes which may affect the value of the fake-time hours counter 218.

In some embodiments, the fake-time counters 215 may be associated with a fake-time "12/24 mode" parameter 223, which may include a binary variable or bit or flag, to indicate whether a 12-hour or a 24-hour time notation scheme is used. The value of the fake-time "12/24 mode" parameter 223 may be hard-coded or may be user-modifiable; and may be different from the value of the real-time "12/24 mode" parameter 226, thereby allowing the digital watch 200, optionally, to track or present real-time using a first time format (e.g., 12-hour format or 24-hour format) while also tracking and/or presenting fake-time or rounded-time using a second, different, time format (namely, 24-hour format or 12-hour format, respectively).

In some embodiments, the fake-time counters 215 may be associated with a fake-time "AM/PM" parameter 224, which may include a binary variable or bit or flag, to indicate whether the value of the fake-time hours counter 218 is associated with AM or with PM. The value of the fake-time "AM/PM" parameter 224 may be different from the value of the real-time "AM/PM" parameter 225, for example, if the real time is "11:56 AM" whereas the fake-time is rounded up to be "12 PM" or "12:00 PM".

In some embodiments, the value of the rounding interval parameter 221 may be hard-coded in the digital watch, or may be stored in a Read Only Memory (ROM) of the digital watch 221. In other embodiments, the value of the rounding interval 221 may be modifiable by the user of the digital watch 221, by operating one or more buttons or by operating a user interface 231 of the digital watch 200 or by otherwise providing user input to the digital watch 200, for example, by switching or selecting one from among multiple preset values of rounding intervals available for the user to select from.

In some embodiments, other suitable circuits, components and/or code may be used. For example, in some other demonstrative embodiments, in which only rounded-hour information is presented, only two counters may be used: a first counter which tracks the hours, and a second counter which tracks the seconds. Such circuit, for example, may receive a signal pulsing at 60 Hz; may increment by one the seconds counter once per second; and when the seconds counter reaches 3600, the hours counter may be incremented by one, while the seconds counter wraps-around to zero or resets to zero, and while a wrap-around check is made for the hours counter in order to wrap-around the hours (if needed) from 13 to 1, or from 24 to zero. Such circuit may entirely obviate the need for a minutes counter, since it may not be required for a digital watch which presents only hours and not minutes to track minutes. Optionally, such clocking circuit may be initialized exactly on a round-hour (e.g., at exactly 4:00:00 PM), either by a user command or by receiving a signal from another unit or an external source (e.g., a wireless signal or a wired signal or a cellular communication signal) indicating a whole-hour and/or its value. Other suitable clocking circuits may be used.

In the demonstrative embodiment shown, two parallel circuits or sets-of-counters exist side-by-side and operate in parallel, substantially continuously, or are synchronized or updated once per second or at other suitable rate. In other embodiments, a single circuit may be used to track the fake time; for example, if only fake time is to be displayed, and real time is not of interest and is not to be displayed, then a single clocking circuit may be used in order to measure time and calculate the rounded time or the fake-time to be displayed.

In some embodiments, the digital watch 200 may optionally display an indication whether the rounded time which is displayed is behind the real current time or ahead of the real current time. In some embodiments, this may be indicated using a particular character or symbol, for example, such that "5+" may indicate that the rounded time is 5 while the real time is already past 5 o'clock; or such that "5−" may indicate that the rounded time is 5 while the real time is still before 5 o'clock. In some embodiments, the indication may further hint or reflect the length of the difference between the rounded time and the real time; for example, such that a displayed rounded time of "5+" may correspond to real time of 5:05, whereas a displayed rounded time of "5++" may correspond to real time of 5:13, whereas a displayed current time of "5+++" may correspond to real time of 5:22, or the like. In some embodiments, if the real time is earlier than the rounded displayed time, then the rounded displayed time may be accompanied by an indication that "it is almost" the displayed time, as demonstrated in FIG. 6. In some embodiments, if the real time is later than the rounded displayed time, then the rounded displayed time may be accompanied by an indication that "it is after" the displayed time, as demonstrated in FIG. 7. In some embodiments, the clocking circuit 228 may include particular logic, sub-circuit or code able to check whether the rounded time is earlier or later than the real time (e.g., as part of the determination of the rounded time, or as a separate process therefrom); and to generate the suitable indicator—"it is almost" or "it is after" (or equivalent indicators)—to be displayed in proximity to the display of the rounded time, e.g., as demonstrated in FIGS. 6 and 7.

Digital watch 200 may further include a housing 230 or other enclosure or packaging or case, able to contain, hold and/or embed and/or mount and/or wrap some or all of the components of the digital watch 200.

Digital watch 200 may further include a user interface 231 able to receive input from a user, for example, user commands to set or modify the time, user commands to set an alarm function, user commands to operate a stopwatch functionality, or the like. The user interface 231 may include, for example, a button, multiple buttons, a touch-screen, a multi-touch screen, a scroll-wheel, a touch-pad, a joystick, a track-ball, a mouse, a stylus, a slider, a button which is accessible by a finger or by a fingernail or only by a sharp object (e.g., a pen or a needle), or the like. In some embodiments, other suitable types of user interfaces may be used, for example, an interface allowing the digital watch 200 to receive input using wired links and/or wireless links, an interface allowing the digital watch 200 to receive input using speech uttered by a user (e.g., using a microphone to capture audio and a speech recognition module to recognize a command from the captured audio), an interface able to capture and recognize gestures or movements of a user, or the like.

The digital watch 200 may optionally include an illumination unit 232 or other light source able to provide illumination to the display 209, for example, substantially continuously or upon receiving a user command.

The digital watch 200 may optionally include a speaker 233 or a set of speakers able to produce audible sound, beeps, music, speech, or other audible signals. In some embodiments, the speaker 233 may be associated with a synthesizer 234 or other suitable component able to generate sound based on pre-recorded samples or based on other digital representation of audio. For example, in some embodiments, an audio recordings memory unit 235 may store fourteen data items: digital data representing an audio recording of the word "one"; digital data representing an audio recording of the word "two"; digital data representing an audio recording of the word "three"; digital data representing an audio recording of the word "four"; digital data representing an audio recording of the word "five"; digital data representing an audio recording of the word "six"; digital data representing an audio recording of the word "seven"; digital data representing an audio recording of the word "eight"; digital data representing an audio recording of the word "nine"; digital data representing an audio recording of the word "ten"; digital data representing an audio recording of the word "eleven"; digital data representing an audio recording of the word "twelve"; digital data representing an audio recording of the word "o'clock"; digital data representing an audio recording of the phrase "it is now". In some embodiments, the user may press a button or may otherwise request, by using the user interface 231, to hear an audible representation of the rounded hourly time; by using a lookup table or an array of pointers, the digital watch 200 may playback the suitable pre-stored audio recording which corresponds to the rounded hour, preceded by the audio recording of the phrase "it is now" and followed by the audio recording of the word "o'clock". Optionally, composer circuitry 236 may be included in the digital watch 200 in order to construct the suitable phrase for playback. Other suitable audio recordings may be used, for example, an audio recording corresponding to "AM" or "PM", an audio recording for the phrase "the time is", or the like.

In some embodiments, the digital watch 200 may include a microphone 237 able to capture audio, sound and/or speech, which may be temporarily stored in a memory unit 238 (e.g., Random Access Memory (RAM), Flash memory, or the like). A speech recognition module 239 or other speech-to-text module may be used to convert the captured audio into text or into user commands, in order to allow the user to provide voice commands to the digital watch 200.

In some embodiments, the digital watch 200 may include a question-and-answer module 240 which may be tailored, for example, for a particular user or to a type of users, to children. For example, the question-and-answer module 240 may be initiated upon a user command, e.g., a child pressing a particular button of the digital watch. In response to the button press, the digital watch 200 plays back, through the speaker 233, a pre-recorded audio message of the phrase "Can you read the time?" or "Please tell me what is the time"; such pre-recorded audio message(s) may be pre-stored in the audio recordings memory unit 235. Then, the microphone 237 may capture audio which may be uttered by the user, and the speech recognition module 239 may extract from the captured audio data corresponding to time as uttered by the user. The extracted data may be compared, by the question-and-answer module 240, to the current value of the rounded time or the rounded hour; and based on the comparison result, a pre-recorded audio recording of either "You are correct" or "You are incorrect" may be played by the speaker 233. For example, if the user (e.g., a child) says "it is five", and the rounded-time is 5 PM or 5 AM, then the question-and-answer module 240 may output an audible phrase corresponding to "You are correct". In contrast, if the rounded-time is not 5 AM and not 5 PM, then the question-and-answer module 240 may output an audible phrase corresponding to "You are incorrect", optionally followed by an audible phrase corresponding to the correct rounded-time, or alternatively, optionally followed by an audible phrase such as "No, please try again" and then followed by repeating the question-and-answer process, e.g., for a pre-defined number of iterations (e.g., three attempts) or until the user is correct or until the earlier of this conditions holds true.

In some embodiments, the digital watch 200 may include a processor 242 able to execute instructions or code described herein and/or other suitable instructions to implement one or more of the functions described herein. The processor 242 may include, for example, a Central Processing Unit (CPU), a Digital Signal Processor (DSP), one or more processor cores, a single-core processor, a dual-core processor, a multiple-core processor, a microprocessor, a host processor, a controller, a plurality of processors or controllers, a chip, a microchip, one or more circuits, circuitry, a logic unit, an Integrated Circuit (IC), an Application-Specific IC (ASIC), or other suitable multi-purpose or specific processor or controller.

The digital watch 200 may include a setting mechanism 241 allowing the user to set and/or modify one or more parameters or functions of the digital watch 200 and/or to tweak its functionality. For example, one or more buttons in the user interface 231 may be used in order to command the setting mechanism to set or modify the real-time information (e.g., hours, minutes, and/or seconds), the fake-time or rounded information, the granularity or resolution of rounding (e.g., which may be stored in the parameter indicating the rounding interval 221), the day-of-week, the calendar date, or the like. In some embodiments, the setting mechanism 241 may operate to directly or indirectly modify, set or reset the content or the values stored in one or more real-time counters 205 and/or fake-time counters. In some embodiments, optionally, the settings mechanism 241 may operate by modifying the frequency of signals or pulses which is provided or gated to one or more of the counters; for example, in response to a user actuation of a "fast" setting button in the user interface 231, the setting mechanism 241 may drive a 60-Hz signal to the minutes counter; in response to a user actuation of a "slow" setting button in the user interface 231, the setting mechanism 241 may drive a 1-Hz signal to the minutes counter; or the like. Other suitable mechanisms may be used.

In some embodiments, the setting mechanism 241 and/or the user interface 231 may be used in order to switch the digital watch 200 among two or more modes of operation or among two or more modes of display; for example, among the various display format shown in the various Figures. In some embodiments, a user-modifiable parameter (or a set of parameters) may be stored in the memory unit 238, and may indicate which display mode and/or operating mode is currently active. In some embodiments, such user-modifiable parameter may allow the user to utilize the digital watch 200 in a flexible way, such that the digital watch 200 may automatically modify its mode of operation if one or more pre-set conditions are met. For example, in some embodiments, the user may set the digital watch 200 to display unrounded real time during certain time-slots (e.g., from 7:01 AM until 10:50 PM), and to display rounded horological information during certain other time-slots (e.g., from 10:51 PM until 7:00 AM). In some embodiments, optionally, digital watch 200 may include a sensor (e.g., an optical sensor) able to acquire visual properties or images, and able to autonomously determine whether the current real time is day-time or night-time (e.g., based on sensing or measuring of light or darkness or other properties); and may transfer to the processor 242 a signal indicating the measurement or the determination; and such signal or measurement or determination may be utilized by the processor 242 in order to automatically and autonomously switch the digital watch 200 from a first mode of operation to a second mode of operation, or from a first display mode or display format to a second display mode or display format.

In some embodiments, processor 242 may instruct the display unit 202 to present the rounded horological information using one or more display modes or formats which may be selected by the user. In some embodiments, for example, the processor 242 may convert numeral symbols to words, such that if the real time is "4:57" and the rounded time is "5", then the digital clock 200 may display the word "Five" or the term "Five O'clock". In some embodiments, if the rounded time is determined to be "4:30", then the digital watch may display the indication "4½" or the phrase "Half Past Four", or the like. In some embodiments, digital watch 200 may substantially continuously display the rounded horological information in a non-flashing manner or a non-blinking manner, or in a manner which substantially continuously shows on the display 209 the full rounded horological information (namely, "5" or "5:00" or "5:00 PM"); and not in a manner which, for example, shows the rounded hours value (e.g., "5") for a short period of time (e.g., for one second), and then shows the minutes value (e.g., "00") and/or the other components (e.g., "PM") of the horological information. In some embodiments, substantially the entire "rounded horological information" may be presented substantially continuously on the display 209.

In some embodiments, the digital watch 200 may include a hard-coded or user-modifiable "real-time/fake-time" parameter 243 indicating to the digital watch 200 which type or types of time information to present. For example, the "real-time/fake-time" parameter 243 may store a value indicating that only rounded time is to be displayed; a value indicating that only real-time is to be displayed; a value indicating that both rounded-time and real-time are to be displayed; a value indicating that only rounded-time is to be displayed using an enlarged font or size; a value indicating that rounded-time is to be displayed using enlarged font or size, together with a reduced-size or reduced-font-size display of the real time, or vice versa; a value indicating that if the rounded time differs from the real time by less than K minutes (e.g., five minutes) or by more than N seconds (e.g., 320 seconds), then only the rounded time is to be displayed and not the real time; or the like.

In some embodiments, the digital watch 200 may be adapted to perform both rounding-up of hours or time and also rounding-down of hours or time; for example, such that a real time of "4:57" may be rounded-up to "5" or to "5:00", and such that a real time of "5:04" may be rounded-down to "5" or to "5:00". In other embodiments, the digital watch 200 may be adapted to perform only rounding-up of hours or time and not to perform rounding-down of hours or time; for example, such that a real time of "4:57" may be rounded-up to "5" or to "5:00", and such that a real time of "5:04" may not be rounded-down to "5" or to "5:00" (but rather, may be maintained and/or displayed as "5:04"). In other embodiments, the digital watch 200 may be adapted not to perform rounding-up of hours or time, and to perform rounding-down of hours or time; for example, such that a real time of "4:57" may not be rounded-up to "5" or to "5:00" (but rather, may be maintained and/or displayed as "4:57"), and such that a real time of "5:04" may not be rounded-down to "5" or to "5:00". In other embodiments, the digital watch 200 may be set or adapted, upon receiving a user command, or if one or more conditions hold true, to cease presentation of fake-time or rounded-time and to present only real time, e.g., until the user commands the digital watch 200 to display fake-time or rounded-time.

In some embodiments, digital watch 200 may include other suitable modules or circuits or codes, for example, to implement a stopwatch function; to implement an alarm function; to implement a countdown or a timer function; to implement an on-the-hour beeping or signaling function; to implement an on-the-half-hour beeping or signaling function; to implement a calculator function; to implement a schedule function; to implement a to-do list function; to implement an address book function; to implement an electronic mail (email) function; to implement a cellular phone function; to implement a wireless communication function; to implement a wired communication function; to implement an Internet browsing function; to implement a game or a gaming function; to implement a map or mapping function; to implement a navigation function; to implement a Global Positioning System (GPS) function; to implement a geo-location function; to implement Location-Based Services (LBS); to implement dynamic or static route guidance; to implement a Virtual Social Network (VSN) function; to implement a file transfer or a file sharing function; to implement a file upload or a file download function; to implement an electronic reader or electronic book reader function; to implement an audio/video playback function; to implement an audio/video capture function; to implement a photograph or image capture function; or the like.

In some embodiments, the digital watch 200 may include a "fuzzy alarm" mechanism 245 able to provide the user with an alarm signal (e.g., a beep, an audible sound, an image, an animation, an audio/video clip, a vibration, or the like) when a target time is reached. The fuzzy alarm mechanism 245 may be different from conventional alarm functions. In some embodiments, for example, the user of digital watch 200 may utilize the user interface 231 to enter a target time in which the user desires the alarm to be generated; and the user may utilize only fake-time or round-time notations. For example, instead of commanding the digital watch 200 to generate an alarm at a target time of "4:57", the user may command the digital watch to generate an alarm at rounded-time of "5". In response to such user command, a fake-time alarm target parameter 246 may store information to indicate that the user requests to be alarmed when the fake time is "5". Optionally, a "fuzzy/exact alarm" parameter 248, which may be implemented using a binary variable or flag or bit, may be set to indicate that the user's request relates to "fuzzy" or rounded time, and not to exact time. Then, a comparator 249 continuously compares the data in the fake-time alarm target parameter 246 to the data stored in the fake-time counters 215, and triggers an alarm (e.g., utilizing the speaker 233 and/or the display 209) upon a match. For example, if the user commands the digital watch to generate an alarm at a "fuzzy" time or non-exact time or fake time or rounded time of "5", and the real time is "4:30" or "4:57" or "5:08", and due to a 60-minute rounding interval the fake-time hours counter 218 has a value of "5", then the comparator may determine a match and may initiate an alarm. This function may allow the user, who may generally utilize the rounded time of digital watch 200, to also use rounded time for purposes of alarm signaling, such that the alarm may be generated even when the real time differs from the rounded time, is ahead of the rounded time, or is behind the rounded time. In other embodiments, the digital watch 200 may allow the user to command a non-fuzzy alarm or an exact-time alarm, which target time may be stored in a real-time alarm target parameter 247; optionally, while toggling or modifying the value of the fuzzy/exact alarm parameter 248 to indicate that the alarm requested is to be based on real time and not rounded time); and in such cases, the comparator 249 may compare the alarm target stored in the real-time alarm target parameter 247 with the values of the RT counters 205, and may initiate an alarm signal upon determining a match. In some embodiments, the fuzzy alarm mechanism 245 may optionally include other alarm functionalities, for example, a "snooze" button and function allowing the user to hit a button or otherwise signal to the digital watch to temporarily pause the alarm generation and to re-start the alarm generation after a pre-defined interval (e.g., two minutes, or three minutes), unless the user actively disables the alarm generation or otherwise signals that the user commands to terminate all alarm functionality.

Some embodiments may be utilized in conjunction with a small-form-factor device, a reduced-form-factor device, a limited-form-factor device, a size-restricted device, a miniature device, or other devices in which it is required or preferred to maintain a small size or form. For example, in some embodiments, a digital or electronic device may have a display unit which may be small (e.g., the size of 8 by 8 millimeters) as to not allow presentation of full horological information (e.g., in the format of "4:57:28" or even "4:57"), yet sufficiently adequate to display a single integer (e.g., "5") in the range of 1 to 12 to indicate the hours component, or the rounded hours component, of the horological information; and such component, which is the most significant component of the horological information, may thus be provided to the user even though the device, or its display unit, are limited or extremely limited in the area available for displaying such horological information. Additionally or alternatively, in some embodiments, given a fixed size of digital device or digital display (e.g., two inches by two inches), some embodiments may allow to display to the user—in the same fixed display area—the rounded horological information (e.g., "5") at a larger or much larger size or font-size (e.g., 150% larger, 200% larger, 250% larger, 300% larger, 400% larger, or the like), instead of displaying on that same fixed display area the full horological information (e.g., "4:57:28" or even "4:57") at a much smaller font or font-size. Some embodiments may thus provide ease-of-use and ease-of-reading, for example, to glasses-wearing users or to older people, who may prefer that a particular digital or electronic device present them, in the fixed display area that it includes, a shortened or rounded version of the time using a larger font, rather than full and less-significant horological information.

In some embodiments, digital watch 200 may be implemented to include, or to be included within, an electronic device, a wired computing device, a wireless computing device, a desktop computer, a laptop computer, a PDA device, a cellular phone, a laptop computer, a notebook computer, a netbook computer, a cellular phone, a mobile phone, a smartphone, a hybrid PDA device/cellular phone, an audio/video player, an iPod device, an Ipod Touch device, an iPhone device, an iPad device, a Blackberry device, a Palm device, or the like.

In some embodiments, optionally, digital watch 200 may include a wired and/or wireless communication unit 251 allowing the digital watch to communicate and/or interact with other devices or systems or networks through one or more communication channels or mediums utilizing wired and/or wireless communication links. The communication unit 251 may include, for example, a wired or wireless transceiver or transmitter-receiver, a wired or wireless modem, a wired or wireless Network Interface Card (NIC) or adapter, or other unit suitable for transmitting and/or receiving communication signals, blocks, frames, transmission streams, packets, messages and/or data. Optionally, communication unit 126 may include, or may be associated with, one or more antennas or one or more sets of antennas. Such antenna(s) may be or may include an internal and/or external Radio Frequency (RF) antenna, for example, a dipole antenna, a monopole antenna, an omni-directional antenna, an end fed antenna, a circularly polarized antenna, a micro-strip antenna, a diversity antenna, or any other type of antenna suitable for transmitting and/or receiving wireless communication signals, blocks, frames, transmission streams, packets, messages and/or data.

In some embodiments, the communication mediums may be or may include, for example, a shared access medium, a global communication network, the Internet, the World Wide Web, a wired network, a wireless network, a combination of one or more wired networks and/or one or more wireless networks, or the like. In some embodiments, the mediums may include one or more communication networks, for example, an a-synchronic or asynchronous wireless network, a synchronic wireless network, a managed wireless network, a non-managed wireless network, a burstable wireless network, a non-burstable wireless network, a scheduled wireless network, a non-scheduled wireless network, or the like. In some embodiments, digital watch 200 may be implemented as a software module and/or hardware component of a computer or computing device or electronic device which may include, for example, a processor, a memory unit (e.g., Random Access Memory (RAM), Read Only Memory (ROM), Flash memory, volatile or non-volatile memory), a storage unit (e.g., hard disk drive, optical drive), an input unit (e.g., keyboard, mouse, touch-pad, touch-screen), output unit (e.g., monitor, display unit), an Operating System (OS), software applications, or the like.

In some embodiments, some or all of the components of digital watch 200 may be enclosed in the housing 230 or other packaging or enclosure, and may be interconnected or may be operably associated using one or more wired or wireless links. In other embodiments, components of digital watch 200 may be distributed among multiple or separate devices or locations.

In some embodiments, the digital watch 200 may be part of a client/server system, a publisher/subscriber system, a system utilizing fully centralized architecture or partially centralized architecture, a system utilizing fully distributed architecture or partially distributed architecture, a system utilizing scalable Peer to Peer (P2P) architecture, or other suitable architectures or combinations thereof.

In some embodiments, the digital watch 200 and/or its features and/or its functionalities may be implemented and/or included in a hand-held device, a portable device, a consumer electronic device, a cellular phone, a smart phone, a cordless phone, a wireless communication device, a wireless device, a portable device, or the like. In some embodiments, the digital watch 200 and/or its features and/or its functionalities may be hard-coded into such device, or may be implemented using Read Only Memory (ROM) or firmware. In other embodiments, the digital watch 200 and/or its features and/or its functionalities may be implemented for such devices as a program, an application, a code, a source code, an executable program, a compiled program, an interpreted program, a downloadable program, an installable program, a program which is stored and/or accessed and/or executed locally, a program which is stored and/or accessed and/or executed remotely (e.g., using a Web browser, using cloud computing, using remote access mechanisms, using a plug-in or browser extension or add-on, using Flash, using Shockwave, using Java, using JavaScript, using VBscript, or the like). In some embodiments, the digital watch 200 and/or its features and/or its functionalities may be implemented as an application or a software program; as an application or software program for Microsoft Windows operating system(s) and/or for Apple Mac OS operating system and/or for Linux or Unix operating system(s), or the like. In some embodiments, the digital watch 200 and/or its features and/or its functionalities may be hard-coded into such device, or may be implemented as an application for iPhone, for iPod, for iPod Touch, for iPad, for Blackberry, or for other suitable devices.

In some embodiments, the digital watch 200 (or features thereof, or functionalities thereof) may be implemented or simulated or emulated as computer program, as part of an Operating System (OS), or as a screen-saver application or as part of a screen-saver module, e.g., an application or module or OS-component which is automatically activated or invoked once a computer or computing device or electronic device is idle (or, is not touched by a user) for a pre-defined or user-modifiable period of time (e.g., five minutes). In some embodiments, for example, a screen-saver application or module may cause the display of rounded horological information, e.g., exclusively on a display unit, or together with other textual elements and/or graphical elements (e.g., flying toasters). In some embodiments, optionally, the rounded horological information (e.g., "5", when the current real time is "4:57:38") may be substantially continuously, or periodically, moved or animated on the display unit of the computer or computing device, in order to provide screen-saver functionality and to avoid a possible "burning-in" of a constant non-changing display into the display unit.

Reference is made to FIGS. 18-21, which are schematic illustrations of an electronic device 300 incorporating a digital watch in accordance with some demonstrative embodiments. Electronic device 300 may be, for example, similar to an iPhone, an iPod, an iPod Touch, an iPad, a Blackberry device, a Palm device, a Nokia mobile phone, a Motorola mobile phone, a Sony-Ericsson mobile phone, a Samsung mobile phone, or the like.

The electronic device 300 may be able to perform multiple functions, for example, playback of audio, playback of video, display of image files, cellular phone communication, cellular texting (SMS and/or MMS) capabilities, calendar functions, to-do list functions, gaming functions, or the like. The electronic device may include, for example, a processor, a memory unit, a storage unit, a communication unit, a power source (e.g., rechargeable), a camera (e.g., located at the back side of the electronic device, opposite the side of the display), and other suitable hardware components and/or software modules.

The electronic device 300 may include a housing or case 310 embedding or holding a display unit 301 which may include, for example, a screen or a touch-screen or a multi-touch screen able to display information and/or able to receive input from a user. The electronic device may include a user interface allowing a user to input commands or data; the user interface may be implemented, for example, using a touch-screen or multi-touch screen (e.g., using the display unit 301), using a single button 302, using multiple buttons or keys or a touch-pad, or the like.

The electronic device 300 may include a program, which may be implemented using hardware and/or software and/or firmware and/or otherwise, and which may implement or emulate or simulate the functionality of digital watch 100 and/or digital watch 200; and may be able to calculate and display rounded horological information or child-friendly information.

For example, the electronic device 300 may determine that the current real time is "2:57" or "2"57:38"; and may substantially continuously display, for example, "3" (FIG. 18); or "3:00" (FIG. 19); or "3 PM" (FIG. 20) as hourly-rounded horological information; or the like.

Figure 21:
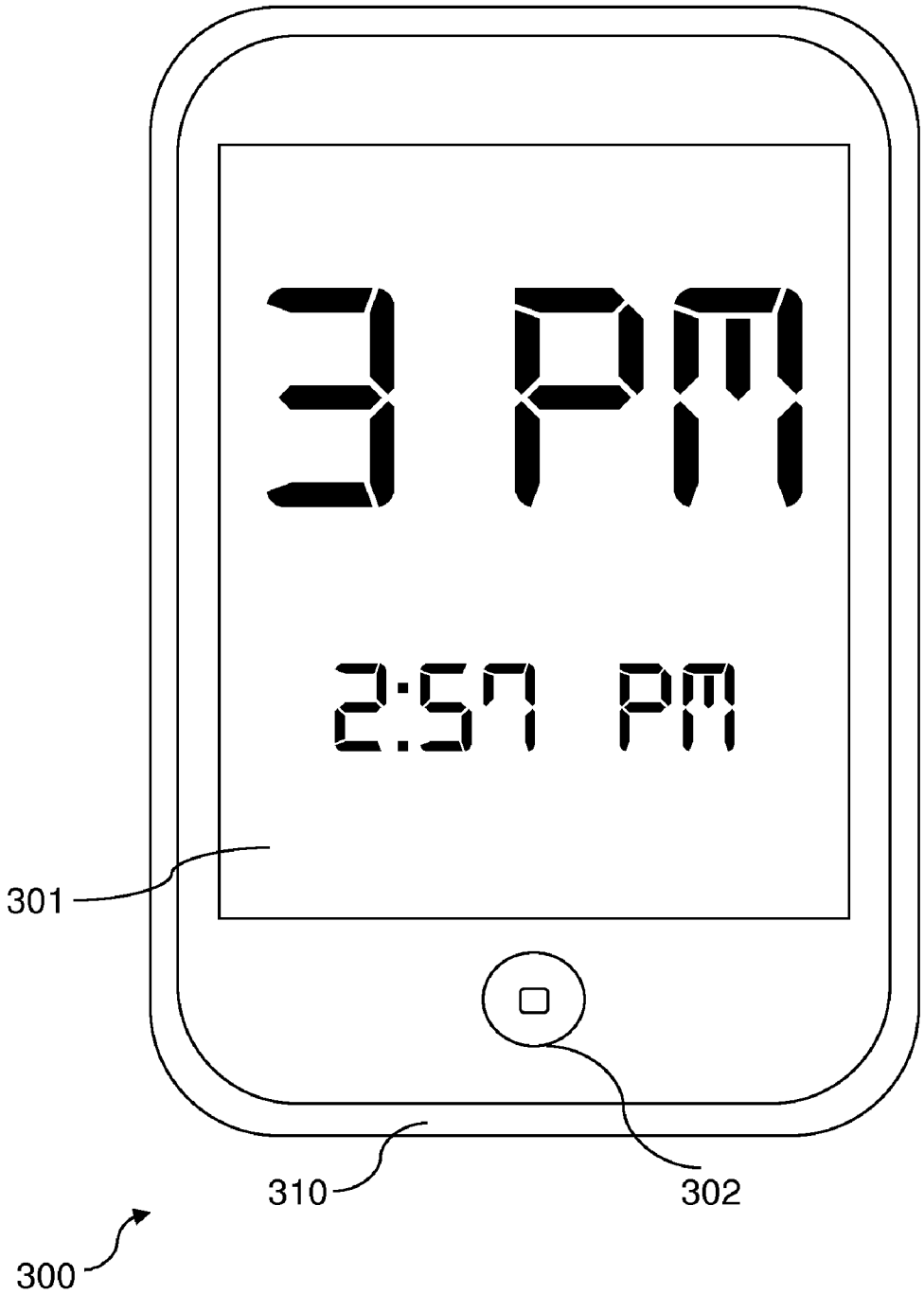
Figure 22:
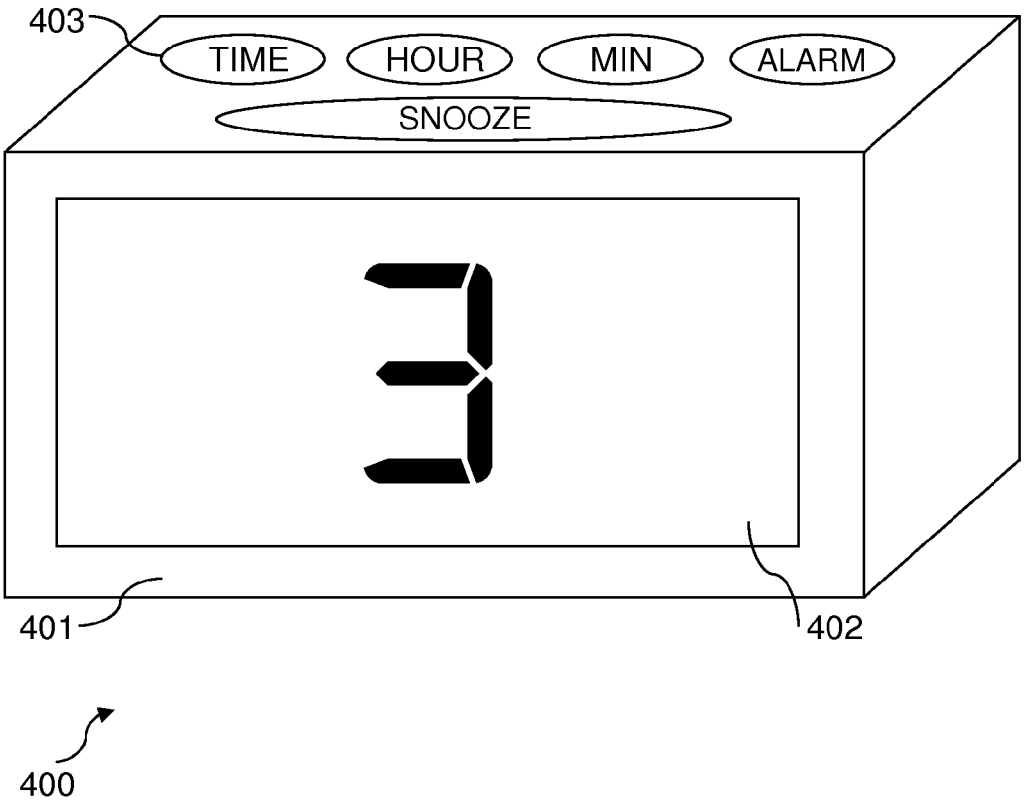
FIGS. 22-25 are schematic illustrations of a digital clock in accordance with some demonstrative embodiments.
Figure 23:
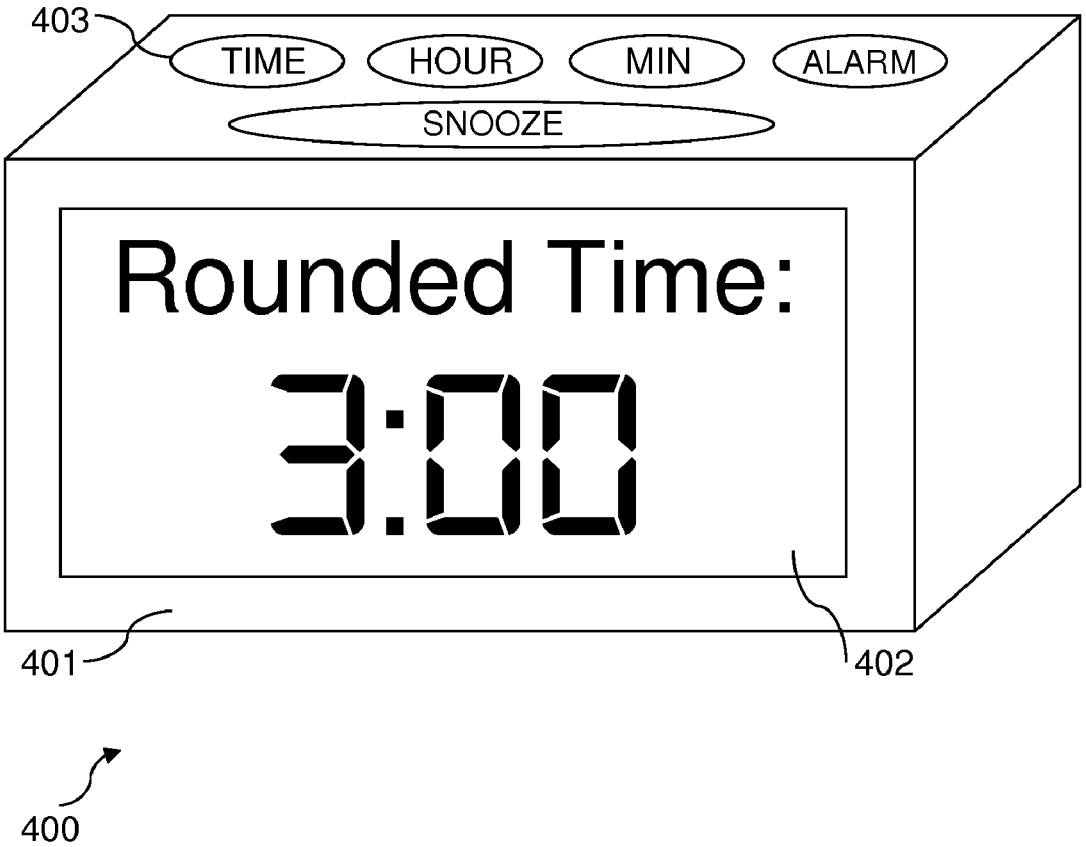
Figure 24:
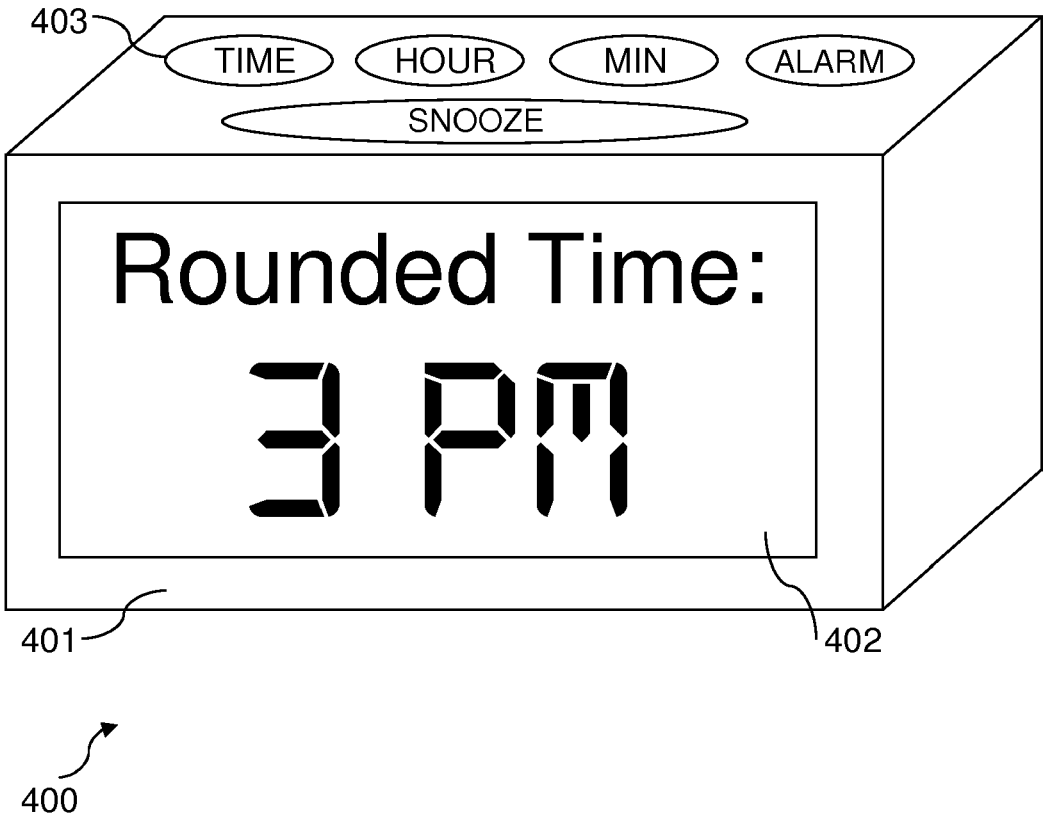

In some embodiments, for example, as demonstrated in FIG. 21, optionally, the electronic device 300 may present a first indication (e.g., having a larger size) of the rounded time (e.g., "3 PM"); together with a second indication (e.g., having a smaller size) of the non-rounded time or real time or truncated time (e.g., "2:57:39" or "2:57:39 PM" or "2:57" or "2:57 PM").

In some embodiments, the electronic device 300 may allow the user to switch among two or more modes of presenting the time, including modes and horological formats that are demonstrated in any of the Figures herein.

In some embodiments, the electronic device 300 may implement or simulate or emulate the digital watch (or features thereof, or functionalities thereof) as a program, as part of an Operating System (OS), or as a screen-saver application or as part of a screen-saver module, e.g., an application or module or OS-component which is automatically activated or invoked once a the electronic device 300 is idle (or, is not touched by a user) for a pre-defined or user-modifiable period of time (e.g., five minutes). In some embodiments, for example, a screen-saver application or module of the electronic device 300 may cause the display of rounded horological information, e.g., exclusively on a display unit, or together with other textual elements and/or graphical elements (e.g., flying toasters). In some embodiments, optionally, the rounded horological information (e.g., "5", when the current real time is "4:57:38") may be substantially continuously, or periodically, moved or animated on the display unit 301, in order to provide screen-saver functionality and to avoid a possible "burning-in" of a constant non-changing display into the display unit 301.

Reference is made to FIGS. 22-25, which are schematic illustrations of a digital clock 400 in accordance with some demonstrative embodiments. The digital clock 400 may include components and/or functionalities which may be similar or identical to those of digital watch 200 and/or digital watch 100; yet digital clock 400 may be implemented as a shelf-clock or portable-clock or stand-alone clock, rather than as a wristwatch or a watch.

In some embodiments, for example, digital clock 400 may include a housing 401 enclosing therein components which may be similar to the components of digital watch 200 and/or digital watch 100. The housing 401 may be generally box-shaped, or generally prism-shaped; and may include a display unit 402 which may be embedded therein as (or in) one of the vertical walls or panels of the digital clock 400. Additionally, the digital clock 400 may include a user interface, for example, one or more buttons 403 which may be located on the top wall of digital clock 400 or at other suitable locations. In some embodiments, digital clock 400 may be self-powered using an internal power source (e.g., rechargeable or non-rechargeable battery), and/or may be powered by receiving power through a wire or cable from a wall electricity socket. In some embodiments, digital clock 400 may include a radio receiver or other radio circuitry able to receive Radio Frequency (RF) signals, e.g., AM radio signals and/or FM radio signals and/or satellite radio signals; or a module able to perform other audio/video playback capabilities (e.g., playback of MP3 audio files or other suitable audio/video data).

In some embodiments, the electronic clock 400 may determine that the current real time is "2:57" or "2"57:38"; and may substantially continuously display, for example, "3" (FIG. 22); or "3:00" (FIG. 23); or "3 PM" (FIG. 24) as hourly-rounded horological information; or the like.

Figure 25:
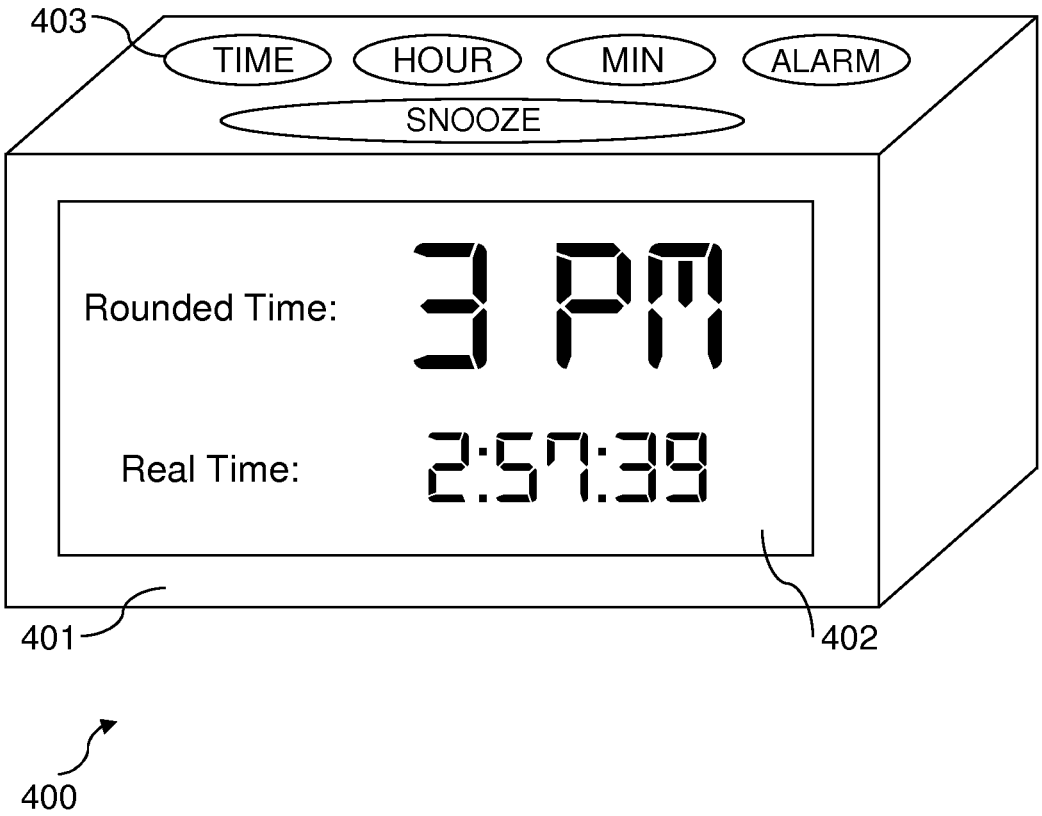

In some embodiments, for example, as demonstrated in FIG. 25, optionally, the digital clock 400 may present a first indication (e.g., having a larger size) of the rounded time (e.g., "3 PM"); together with a second indication (e.g., having a smaller size) of the non-rounded time or real time or truncated time (e.g., "2:57:39" or "2:57:39 PM" or "2:57" or "2:57 PM").

In some embodiments, the digital clock 400 may allow the user to switch among two or more modes of presenting the time, including modes and horological formats that are demonstrated in any of the Figures herein.

Some embodiments may include, for example, methods for measuring and/or tracking time which may be able to determine and/or calculate and/or computer fake time or rounded horological time, and may display such rounded horological time instead of displaying current real time or in addition to displaying current real time.

Figure 26:
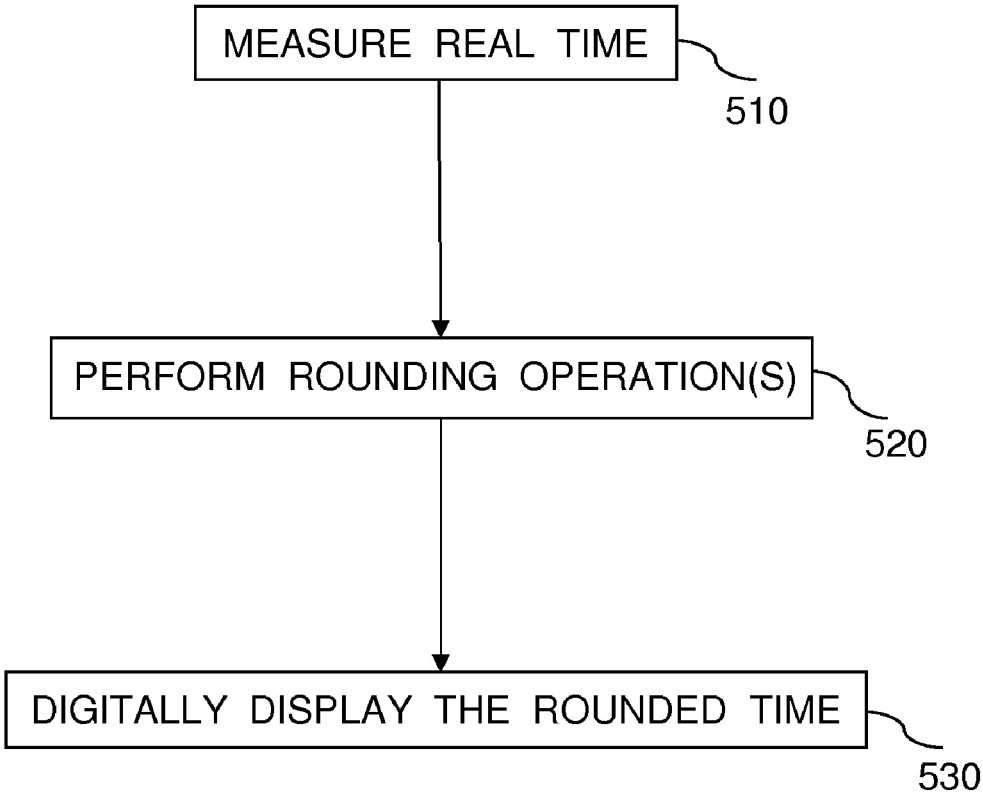
FIG. 26 is a schematic flow chart of a method of calculating and displaying time, in accordance with some demonstrative embodiments.

Reference is made to FIG. 26, which is a schematic flow chart of a method of calculating and displaying time, in accordance with some demonstrative embodiments. The method may be performed, for example, by digital watch 100, by digital watch 200, by electronic device 300, by digital clock 400, by a clocking circuit or module, or by other suitable devices and/or systems.

In some embodiments, for example, the method may include measuring real time (block 510); performing one or more rounding operations on at least one horological component of the real time (block 520), e.g., performing a rounding-up operation by incrementing the hours value; and digitally displaying (e.g., substantially continuously, or in a substantially continuous manner) the rounded horological information (e.g., the rounded-up horological information) (block 530), for example, instead of displaying the real current time or in addition to displaying the real current time.

In other embodiments, rounded horological time may be calculated and/or displayed without necessarily determining, measuring or tracking the current real time. For example, an initial value for rounded horological time may be provided to a digital watch or a digital clock (e.g., manually by a user, automatically by an external source, from a wired or wireless signal, from a cellular communication signal, as a factory setting, or the like), and the components of the digital watch or digital clock may operate based on such initial rounded value which may be used as a foundation value for tracking time and for presenting rounded horological time, instead of measuring and/or tracking real time.

Other suitable operations or sets of operations may be used in accordance with some embodiments. Some operations or sets of operations may be repeated, for example, substantially continuously, for a pre-defined number of iterations, or until one or more conditions are met. In some embodiments, some operations may be performed in parallel, in sequence, or in other suitable orders of execution.

In some embodiments, for example, a digital wristwatch comprises: a clocking module able to track: (a) current real time, and also (b) rounded time; and a display unit able to substantially continuously display at least the rounded time.

In some embodiments, for example, wherein the display unit is to substantially continuously display the rounded time without displaying the current real time.

In some embodiments, for example, the display unit is able to substantially continuously display a single integer number; wherein the single integer number is an integer in the range of 1 to 12; wherein the single integer number represents the whole horological hour which is closest to current real time; wherein the single integer number is updated exactly once per hour.

In some embodiments, for example, the display unit is to substantially continuously display: (a) the rounded time; and (b) the current real time.

In some embodiments, for example, the display unit is to substantially continuously display: (a) the rounded time; and (b) the current real time, wherein the rounded time is displayed at a size greater than the current real time.

In some embodiments, for example, the clocking module comprises: a real-time hours counter to track real-time hours value; a real-time minutes counter to track real-time minutes value; a rounded-time hours counter to track rounded hours.

In some embodiments, for example, the clocking module is to check whether current content of the real-time minutes counter differs from 60 by not more than a pre-defined rounding interval; and if the check result is positive, to assign to the rounded-time hours counter a value which is equal to: one plus current value of the real-time hours counter.

In some embodiments, for example, if the digital wristwatch utilizes a 12-hour time format, then the clocking module is to wrap-around to 1 a value of 13 assigned to the rounded-time hours counter.

In some embodiments, for example, if the digital wristwatch utilizes a 24-hour time format, then the clocking module is to wrap-around to 0 a value of 24 assigned to the rounded-time hours counter.

In some embodiments, for example, the rounding interval is user-modifiable.

In some embodiments, for example, the rounding interval is approximately 30 minutes, or approximately 60 minutes.

In some embodiments, for example, the display unit is to update the rounded time displayed thereon exactly once per hour.

In some embodiments, for example, the display unit is to update the rounded time displayed thereon exactly twice per hour.

In some embodiments, for example, the digital watch comprises: a user interface to receive a user selection of a display mode, from a set of two or more available display modes; wherein the clocking module is to command the display unit to display horological information according to the user selection of the display mode; wherein the set of two or more available display modes comprises a set including at least two of the following display modes: (a) a display mode which substantially continuously presents only the rounded time; (b) a display mode which substantially continuously presents both the rounded time and the current real time; (c) a display mode which substantially continuously presents the rounded time and, using a smaller font size, the current real time; (d) a display mode which substantially continuously presents, alternately, the rounded time and the current real time.

In some embodiments, for example, a digital wristwatch comprises: a clocking module able to determine current real time; a rounding unit able to determine that the real current time is at least two seconds prior to a rounded horological hour, and able to calculate rounded-up horological information; and a display unit able to display the rounded-up horological hour.

In some embodiments, for example, the rounding unit is able (a) to round-up a first homological information and (b) to round-down a second horological information.

In some embodiments, for example, the rounding unit is, within a period of 3600 seconds, (a) to at least once round-up a first homological information and (b) to at least once round-down a second horological information.

In some embodiments, for example, the clocking module is able to determine, at least once per day, that current real time is 4:58; and wherein upon such determination, (a) the rounding unit is to round-up the time to 5:00, and (b) the display unit is to display the time as either "5" or "5:00".

In some embodiments, for example, the clocking module is to determine rounded horological time in which at least a value of an hours component differs from a value of real-time hours component, if one of the following conditions holds true: (a) current value of real-time minutes component is smaller than 60 by not more than a pre-defined rounding interval; (b) current value of real-time minutes component is smaller than the pre-defined rounding interval.

In some embodiments, for example, the rounding interval is user-modifiable.

In some embodiments, for example, the rounding interval is approximately 30 minutes, or approximately 60 minutes.

Although portions of the discussion herein relate, for demonstrative purposes, to wired links and/or wired communications, some embodiments are not limited in this regard, and may include one or more wired or wireless links, may utilize one or more components of wireless communication, may utilize one or more methods or protocols of wireless communication, or the like. Some embodiments may utilize wired communication and/or wireless communication.

Some embodiments may be used in conjunction with various devices and systems, for example, a Personal Computer (PC), a desktop computer, a mobile computer, a laptop computer, a notebook computer, a tablet computer, a server computer, a handheld computer, a handheld device, a Personal Digital Assistant (PDA) device, a handheld PDA device, an on-board device, an off-board device, a hybrid device (e.g., a device incorporating functionalities of multiple types of devices, for example, PDA functionality and cellular phone functionality), a vehicular device, a non-vehicular device, a mobile or portable device, a non-mobile or non-portable device, a wireless communication station, a wireless communication device, a wireless Access Point (AP), a wireless Base Station (BS), a Mobile Subscriber Station (MSS), a wired or wireless Network Interface Card (NIC), a wired or wireless router, a wired or wireless modem, a wired or wireless network, a Local Area Network (LAN), a Wireless LAN (WLAN), a Metropolitan Area Network (MAN), a Wireless MAN (WMAN), a Wide Area Network (WAN), a Wireless WAN (WWAN), a Personal Area Network (PAN), a Wireless PAN (WPAN), devices and/or networks operating in accordance with existing IEEE 802.11, 802.11a, 802.11b, 802.11g, 802.11n, 802.16, 802.16d, 802.16e, 802.16m standards and/or future versions and/or derivatives of the above standards, units and/or devices which are part of the above networks, one way and/or two-way radio communication systems, cellular radio-telephone communication systems, a cellular telephone, a wireless telephone, a Personal Communication Systems (PCS) device, a PDA device which incorporates a wireless communication device, a mobile or portable Global Positioning System (GPS) device, a device which incorporates a GPS receiver or transceiver or chip, a device which incorporates an RFID element or tag or transponder, a device which utilizes Near-Field Communication (NFC), a Multiple Input Multiple Output (MIMO) transceiver or device, a Single Input Multiple Output (SIMO) transceiver or device, a Multiple Input Single Output (MISO) transceiver or device, a device having one or more internal antennas and/or external antennas, a "smart-phone" device, an iPhone or a similar device, an iPod or iPod Touch or iPad or similar device, a wired or wireless handheld device (e.g., BlackBerry Curve, Palm Pre), a Wireless Application Protocol (WAP) device, a hybrid device (e.g., combining one or more cellular phone functionalities with one or more PDA device functionalities), a portable audio player, a portable video player, a portable audio/video player, a portable media player, a gaming device, a portable or non-portable gaming console, a portable device having a touch-screen, a relatively small computing device, a non-desktop computer or computing device, a portable device, a handheld device, a "Carry Small Live Large" (CSLL) device, an Ultra Mobile Device (UMD), an Ultra Mobile PC (UMPC), a Mobile Internet Device (MID), a Consumer Electronic (CE) device, an "Origami" device or computing device, a device that supports Dynamically Composable Computing (DCC), a context-aware device, or the like.

Some embodiments may be used in conjunction with one or more types of wireless communication signals and/or systems, for example, Radio Frequency (RF), Infra Red (IR), Frequency-Division Multiplexing (FDM), Orthogonal FDM (OFDM), OFDM Access (OFDMA), Time-Division Multiplexing (TDM), Time-Division Multiple Access (TDMA), Extended TDMA (E-TDMA), General Packet Radio Service (GPRS), extended GPRS, Code-Division Multiple Access (CDMA), Wideband CDMA (WCDMA), CDMA 2000, Multi-Carrier Modulation (MDM), Discrete Multi-Tone (DMT), Bluetooth®, Global Positioning System (GPS), IEEE 802.11 ("Wi-Fi"), IEEE 802.16 ("Wi-Max"), ZigBee™, Ultra-Wideband (UWB), Global System for Mobile communication (GSM), 2G, 2.5G, 3G, Third Generation Partnership Project (3GPP), 3GPP Long Term Evolution (LTE), 3.5G, or the like. Some embodiments may be used in conjunction with various other devices, systems and/or networks.

The terms "wireless device", "wireless computing device", "mobile device" or "mobile computing device" as used herein include, for example, a portable or mobile device capable of wireless communication, a portable or mobile communication device capable of wireless communication, a mobile phone, a cellular phone, a laptop or notebook computer capable of wireless communication, a PDA capable of wireless communication, a handheld device capable of wireless communication, or the like.

The terms "social network", "virtual social network", or "VSN" as used herein include, for example, a virtual community; an online community; a community or assembly of online representations corresponding to users of computing devices; a community or assembly of virtual representations corresponding to users of computing devices; a community or assembly of virtual entities (e.g., avatars, usernames, nicknames, or the like) corresponding to users of computing devices; a web-site or a set of web-pages or web-based applications that correspond to a virtual community; a set or assembly of user pages, personal pages, and/or user profiles; web-sites or services similar to "Facebook", "MySpace", "LinkedIn", or the like.

In some embodiments, a virtual social network includes at least two users; in other embodiments, a virtual social network includes at least three users. In some embodiments, a virtual social network includes at least one "one-to-many" communication channels or links. In some embodiments, a virtual social network includes at least one communication channel or link that is not a point-to-point communication channel or link. In some embodiments, a virtual social network includes at least one communication channel or link that is not a "one-to-one" communication channel or link.

The terms "social network services" or "virtual social network services" as used herein include, for example, one or more services which may be provided to members or users of a social network, e.g., through the Internet, through wired or wireless communication, through electronic devices, through wireless devices, through a web-site, through a stand-alone application, through a web browser application, or the like. In some embodiments, social network services may include, for example, online chat activities; textual chat; voice chat; video chat; Instant Messaging (IM); non-instant messaging (e.g., in which messages are accumulated into an "inbox" of a recipient user); sharing of photographs and videos; file sharing; writing into a "blog" or forum system; reading from a "blog" or forum system; discussion groups; electronic mail (email); folksonomy activities (e.g., tagging, collaborative tagging, social classification, social tagging, social indexing); forums; message boards; or the like.

The terms "web" or "Web" as used herein includes, for example, the World Wide Web; a global communication system of interlinked and/or hypertext documents, files, web-sites and/or web-pages accessible through the Internet or through a global communication network; including text, images, videos, multimedia components, hyperlinks, or other content.

The term "user" as used herein includes, for example, a person or entity that owns a watch or wristwatch or clock or other suitable device; a person or entity that operates or utilizes a watch or wristwatch or clock or other suitable device; or a person or entity that is otherwise associated with a watch or wristwatch or clock or other suitable device.

Discussions herein utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

The terms "plurality" or "a plurality" as used herein include, for example, "multiple" or "two or more". For example, "a plurality of items" includes two or more items.

Some embodiments may take the form of an entirely hardware embodiment, an entirely software embodiment, or an embodiment including both hardware and software elements. Some embodiments may be implemented in software, which includes but is not limited to firmware, resident software, microcode, or the like.

Furthermore, some embodiments may take the form of a computer program product accessible from a computer-usable or computer-readable medium providing program code for use by or in connection with a computer or any instruction execution system. For example, a computer-usable or computer-readable medium may be or may include any apparatus that can contain, store, communicate, propagate, or transport the program for use by or in connection with the instruction execution system, apparatus, or device.

In some embodiments, the medium may be or may include an electronic, magnetic, optical, electromagnetic, InfraRed (IR), or semiconductor system (or apparatus or device) or a propagation medium. Some demonstrative examples of a computer-readable medium may include a semiconductor or solid state memory, magnetic tape, a removable computer diskette, a Random Access Memory (RAM), a Read-Only Memory (ROM), a rigid magnetic disk, an optical disk, or the like. Some demonstrative examples of optical disks include Compact Disk-Read-Only Memory (CD-ROM), Compact Disk-Read/Write (CD-R/W), DVD, or the like.

In some embodiments, a data processing system suitable for storing and/or executing program code may include at least one processor coupled directly or indirectly to memory elements, for example, through a system bus. The memory elements may include, for example, local memory employed during actual execution of the program code, bulk storage, and cache memories which may provide temporary storage of at least some program code in order to reduce the number of times code must be retrieved from bulk storage during execution.

In some embodiments, input/output or I/O devices (including but not limited to keyboards, displays, pointing devices, etc.) may be coupled to the system either directly or through intervening I/O controllers. In some embodiments, network adapters may be coupled to the system to enable the data processing system to become coupled to other data processing systems or remote printers or storage devices, for example, through intervening private or public networks. In some embodiments, modems, cable modems and Ethernet cards are demonstrative examples of types of network adapters. Other suitable components may be used.

Some embodiments may be implemented by software, by hardware, or by any combination of software and/or hardware as may be suitable for specific applications or in accordance with specific design requirements. Some embodiments may include units and/or sub-units, which may be separate of each other or combined together, in whole or in part, and may be implemented using specific, multi-purpose or general processors or controllers. Some embodiments may include buffers, registers, stacks, storage units and/or memory units, for temporary or long-term storage of data or in order to facilitate the operation of particular implementations.

Some embodiments may be implemented, for example, using a machine-readable medium or article which may store an instruction or a set of instructions that, if executed by a machine, cause the machine to perform a method and/or operations described herein. Such machine may include, for example, any suitable processing platform, computing platform, computing device, processing device, electronic device, electronic system, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit; for example, memory, removable or non-removable media, erasable or non-erasable media, writeable or re-writeable media, digital or analog media, hard disk drive, floppy disk, Compact Disk Read Only Memory (CD-ROM), Compact Disk Recordable (CD-R), Compact Disk Re-Writeable (CD-RW), optical disk, magnetic media, various types of Digital Versatile Disks (DVDs), a tape, a cassette, or the like. The instructions may include any suitable type of code, for example, source code, compiled code, interpreted code, executable code, static code, dynamic code, or the like, and may be implemented using any suitable high-level, low-level, object-oriented, visual, compiled and/or interpreted programming language, e.g., C, C++, Java, BASIC, Pascal, Fortran, Cobol, assembly language, machine code, or the like.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments have been illustrated and described herein, many modifications, substitutions, changes, and equivalents may occur to those skilled in the art. Accordingly, the following claims are intended to cover all such modifications, substitutions, changes, and equivalents.

What is claimed is:

1. A digital clock comprising:

A clocking module maintaining a measurement of a current time in at least units of hours and minutes and a display which in at least one mode displays a rounded time only in units of hours, wherein the rounded time is obtained by rounding the current time to the nearest hour, such that the displayed rounded time is a simple approximation of the current time, the display additionally displays the current time adjacent the rounded time, and individual indicia of the current time are smaller than indicia of the rounded time.

2. The digital clock of claim 1, wherein the display unit is able to substantially continuously display a integer number, wherein the integer number is an integer in the range of 1 to 12, wherein the integer number represents the whole horological hour which is closest to current real time, wherein the integer number is updated exactly once per hour.

3. The digital clock of claim 1, wherein the display unit is to substantially continuously display: (a) the rounded time; and (b) the current real time.

4. The digital clock of claim 1, wherein the display unit is to substantially continuously display: (a) the rounded time; and (b) the current real time, wherein the rounded time is displayed at a size greater than the current real time.

5. The digital clock of claim 1, wherein the clocking module comprises:

a real-time hours counter to track real-time hours value;

a real-time minutes counter to track real-time minutes value;

a rounded-time hours counter to track rounded hours.

6. The digital clock of claim 5, wherein the clocking module is to check whether current content of the real-time minutes counter differs from 60 by not more than a pre-defined rounding interval; and if the check result is positive, to assign to the rounded-time hours counter a value which is equal to: one plus current value of the real-time hours counter.

7. The digital clock of claim 6, wherein, if the digital wristwatch utilizes a 12-hour time format, then the clocking module is to wrap-around to 1 a value of 13 assigned to the rounded-time hours counter;

wherein, if the digital clock utilizes a 24-hour time format, then the clocking module is to wrap-around to 0 a value of 24 assigned to the rounded-time hours counter.

8. The digital clock of claim 6, wherein the rounding interval is user-modifiable.

9. The digital clock of claim 6, wherein the rounding interval is approximately 30 minutes.

10. The digital clock of claim 1, wherein the display unit is to update the rounded time displayed thereon exactly once per hour.

11. The digital clock of claim 1, further comprising: a user interface to receive a user selection of a display mode, from a set of two or more available display modes; wherein the clocking module is to command the display unit to display horological information according to the user selection of the display mode; wherein the set of two or more available display modes comprises a set including:

(a) a display mode which substantially continuously presents both the rounded time and the current real time; and further including at least one of the following display modes:

(b) a display mode which substantially continuously presents only the rounded time; (c) a display mode which substantially continuously presents the rounded time and, using a smaller font size, the current real time;

(d) a display mode which substantially continuously presents, alternately, the rounded time and the current real time.

12. The digital clock of claim 1, wherein the clock is a wristwatch.

13. The digital clock of claim 1, wherein the digital clock is comprised in a wristwatch.

14. The digital clock of claim 1, wherein the digital clock is comprised in a portable electronic device.

* * * * *